US009977387B2

(12) United States Patent
Shida et al.

(10) Patent No.: US 9,977,387 B2
(45) Date of Patent: May 22, 2018

(54) FIXING APPARATUS

(71) Applicant: CANON KABUSHIKI KAISHA, Tokyo (JP)

(72) Inventors: Tomonori Shida, Mishima (JP); Shun-ichi Ebihara, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/007,560

(22) Filed: Jan. 27, 2016

(65) Prior Publication Data

US 2016/0223974 A1 Aug. 4, 2016

(30) Foreign Application Priority Data

Jan. 29, 2015 (JP) ..... 2015-015063

(51) Int. Cl.
*G03G 15/00* (2006.01)
*G03G 15/20* (2006.01)

(52) U.S. Cl.
CPC ..... *G03G 15/55* (2013.01); *G03G 15/2039* (2013.01)

(58) Field of Classification Search
CPC ..... G03G 15/2039; G03G 15/2053; G03G 15/2042; G03G 15/205; G03G 15/55
USPC ..... 399/33, 67, 328
See application file for complete search history.

(56) References Cited

U.S. PATENT DOCUMENTS 5,677,775 A * 10/1997 Yamaguchi ..... H04N 1/00002 358/437
9,002,229 B2 4/2015 Takami
2012/0120422 A1* 5/2012 Hitaka ..... G03G 15/205 358/1.9
2013/0108299 A1* 5/2013 Minagawa ..... G03G 15/2042 399/69
2013/0195494 A1* 8/2013 Asami ..... G03G 15/2042 399/70

FOREIGN PATENT DOCUMENTS

JP 2009276427 A 11/2009
JP 2011027885 A 2/2011
JP 2013037278 A 2/2013

* cited by examiner

*Primary Examiner* — Walter L Lindsay, Jr.
*Assistant Examiner* — Jessica L Eley
(74) *Attorney, Agent, or Firm* — Rossi, Kimms & McDowell LLP

(57) ABSTRACT

A fixing apparatus including: an acquiring portion that acquires a difference value between a detection temperature of a first temperature detecting member and a detection temperature of a second temperature detecting member; and an alarming portion that sends a notification of an abnormality in the apparatus. The alarming portion sends the notification of an abnormality in the apparatus according to an amount of change in the difference value acquired during a fixing process.

14 Claims, 14 Drawing Sheets

FIXING APPARATUS

BACKGROUND OF THE INVENTION

Field of the Invention

The present invention relates to an image forming apparatus having a heating and fixing apparatus that thermally fixes, as a fixed image, a non-fixed toner image formed and born on a recording material.

Description of the Related Art

In a conventional image forming apparatus of this type, a recording material on which a non-fixed toner image is formed is passed through a fixing nip portion of a heating and fixing apparatus to apply heat and pressure to the toner image so that the toner image is heated and fixed to the recording material.

A recording material is fed from a cassette or a tray and conveyed to a fixing apparatus with a toner image formed thereon in an image forming unit. However, when the recording material is not set appropriately, the recording material may be skewed so that printing accuracy may decrease and a print jam may occur. Moreover, when the recording material is conveyed in a state of being shifted from a reference position, an excessive temperature rise occurs in a non-sheet-passing area of a heating and fixing apparatus and a temperature rise suppressing technique unintentionally operates to suppress the excessive temperature rise, which may decrease the productivity.

Conventionally, such an image forming apparatus as disclosed in Japanese Patent Application Publication No. 2011-27885 has been proposed as a method for determining conveying faults such as skew or positional error conveying of the recording material.

Japanese Patent Application Publication No. 2011-27885 discloses a method of detecting positional error conveying of a recording material when a temperature difference between both ends of the recording material reaches a predetermined value or higher to control the operation of an apparatus using a temperature detector for detecting an increase in the temperature of a non-sheet-passing portion occurring when a recording material having a small size passes.

However, as disclosed in Japanese Patent Application Publication No. 2011-27885, it is difficult to accurately determine the skew or the positional error conveying of the recording material from a temperature difference between both ends in the longitudinal direction of a fixing apparatus occurring due to sheet-passing. That is, the temperature difference between both ends in the longitudinal direction of the fixing apparatus occurs due to various factors such as a lateral difference in the temperature increase within an image forming apparatus, a sensitivity fluctuation among temperature detectors, or a variation in detection temperature resulting from durability deterioration of members as well as the positional error conveying or the skew of the recording material.

Thus, in this determination method, it is difficult to make determination on the positional error conveying of recording materials with high accuracy and a small number of passing sheets, and a large number of sheets needs to be passed to make determination on the positional error conveying. Moreover, it is difficult to detect temporary skew which causes only a small temperature difference in a longitudinal direction.

SUMMARY OF THE INVENTION

An object of the present invention is to provide a fixing apparatus that heats a recording material on which an image is formed while conveying the recording material at a nip portion to fix the image to the recording material, the fixing apparatus comprising:

a heating rotating member;

a backup member that forms the nip portion together with the heating rotating member;

a temperature detecting portion that detects a temperature of the heating rotating member, the temperature detecting portion including a first temperature detecting member that detects a temperature at one end of the heating rotating member in a longitudinal direction of the heating rotating member, and a second temperature detecting member that detects a temperature at the other end of the heating rotating member;

an acquiring portion that acquires a difference value between a detection temperature of the first temperature detecting member and a detection temperature of the second temperature detecting member; and an alarming portion that sends a notification of an abnormality in the apparatus, wherein the alarming portion sends the notification of an abnormality in the apparatus according to an amount of change in the difference value acquired during a fixing process.

Further features of the present invention will become apparent from the following description of exemplary embodiments (with reference to the attached drawings).

DESCRIPTION OF THE EMBODIMENTS

Figure 1:
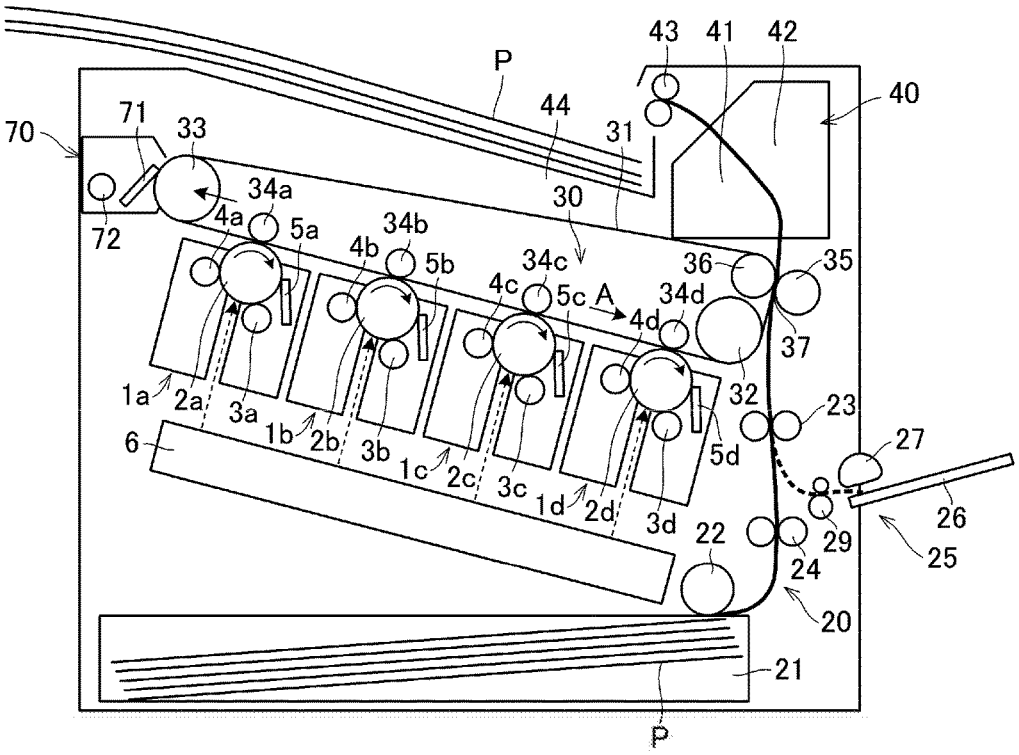
FIG. 1 is a cross-sectional view schematically illustrating an example of an image forming apparatus to which the present invention is applied.

Hereinafter, an image forming apparatus according to an embodiment of the present invention will be described in detail with reference to the drawings. However, materials, shapes, relative positions, and the like of constituent components described in the embodiment are not intended to limit the scope of the invention unless otherwise specified.

Embodiment 1

<Overall Configuration of Image Forming Apparatus>

First, an overall configuration of an image forming apparatus will be described with reference to FIG. 1 together with an image forming operation. The image forming apparatus of the present embodiment is a color laser printer having a process speed of 240 mm/s and a throughput of 40 ppm (A4 Size, Short Edge Feed), which uses a transfer electrophotographic process.

The image forming apparatus includes toner cartridges 1*a*, 1*b*, 1*c*, and 1*d* which are detachably attached to a main body. These four toner cartridges 1*a*, 1*b*, 1*c*, and 1*d* have the same structure and form images using yellow, magenta, cyan, and black toner components, respectively. A scanner unit 6 is disposed below the toner cartridges 1*a*, 1*b*, 1*c*, and 1*d* and performs exposure based on an image signal on photosensitive drums 2*a*, 2*b*, 2*c*, and 2*d*.

The photosensitive drums 2*a*, 2*b*, 2*c*, and 2*d* are charged to a predetermined negative potential level by charging rollers 3*a*, 3*b*, 3*c*, and 3*d*, and electrostatic latent images are formed thereon by the scanner unit 6. The electrostatic latent images are reverse-developed by developing rollers 4*a*, 4*b*, 4*c*, and 4*d* to have negative-polarity toner components attached thereto, which form yellow, magenta, cyan, and black toner images, respectively.

The toner images formed on the photosensitive drums 2*a*, 2*b*, 2*c*, and 2*d* are primarily transferred to an intermediate transfer belt 31 and are conveyed up to a secondary transfer nip portion 37 in a state in which the toner images of four colors are superimposed. Toner images are transferred when each photosensitive drum rotates in a direction indicated by an arrow, the intermediate transfer belt 31 rotates in a direction indicated by arrow A, and a positive bias is applied to primary transfer rollers 34*a*, 34*b*, 34*c*, and 34*d*. The primary transfer rollers 34*a*, 34*b*, 34*c*, and 34*d* are arranged to face the photosensitive drums 2*a*, 2*b*, 2*c*, and 2*d*, respectively.

An intermediate transfer belt unit 30 has the intermediate transfer belt 31 stretched around a driver roller 32, a secondary transfer facing roller 36, and a tension roller 33.

A feeding and conveying apparatus 20 includes a sheet feed cassette 21 as a recording material holding member that holds a sheet P as a recording material, a cassette sheet feed roller 22 that feeds the sheet P from the inside of the sheet feed cassette 21, and a cassette conveying roller 24 that conveys the fed sheet P. When a sheet P is set on the sheet feed cassette 21, a user manually operates a both-end regulating plate for regulating both ends in a width direction of the sheet P and a rear-end regulating plate for regulating the rear end of the sheet P to cause the regulating plates to collide with both ends and the rear end of the sheet P to thereby hold the sheet P. The sheet P conveyed from the feeding and conveying apparatus 20 is conveyed approximately vertically to the secondary transfer nip portion 37 by a registration roller pair 23.

Similarly, the sheet P can be fed and conveyed from a sheet feed tray 26 as another recording material holding member. The feeding and conveying apparatus 25 includes a tray sheet feed roller 27 that feeds the sheet P and a tray conveying roller 29 that conveys the fed sheet P. When a sheet P is set on the sheet feed tray 26, a user manually operates the both-end regulating plate to cause the plate to collide with both ends of the sheet P to hold the sheet P. The sheet feed tray 26 has an inclination and the sheet P is set by allowing a front end of the sheet P to collide with a collision member (not illustrated).

A conveying path from the sheet feed cassette 21 and a conveying path from the sheet feed tray 26 converge on the upstream side of the registration roller pair 23. The sheet P conveyed from the feeding and conveying apparatus 25 is conveyed to the secondary transfer nip portion 37 by the registration roller pair 23 similarly to the sheet P fed and conveyed from the sheet feed cassette 21.

In the secondary transfer nip portion 37, a positive bias is applied to a secondary transfer roller 35, whereby the toner images of four colors on the intermediate transfer belt 31 are secondarily transferred to the conveyed sheet P. The sheet P to which toner images are transferred is conveyed to the fixing apparatus 40 and is heated and pressurized by a fixing film 41 as a fixing member and a pressure roller 42 as a pressure member whereby the toner images are fixed to the surface of the sheet P. The fixing apparatus 40 has a thermistor as a temperature detecting member described later and the image forming apparatus is controlled according to a detection temperature of the thermistor. The sheet P to which toner images are fixed is discharged to a sheet discharge tray 44 by a discharge roller pair 43.

On the other hand, the toner components remaining on the surfaces of the photosensitive drums 2*a*, 2*b*, 2*c*, and 2*d* after toner images are transferred are removed by cleaning blades 5*a*, 5*b*, 5*c*, and 5*d*. Moreover, the toner components remaining on the intermediate transfer belt 31 after toner images are secondarily transferred to the sheet P are removed by a cleaning blade 71 of a transfer belt cleaning apparatus 70, and the removed toner components are passed through a waste toner conveying path 72 and collected into a waste toner collection container (not illustrated).

Figure 10:
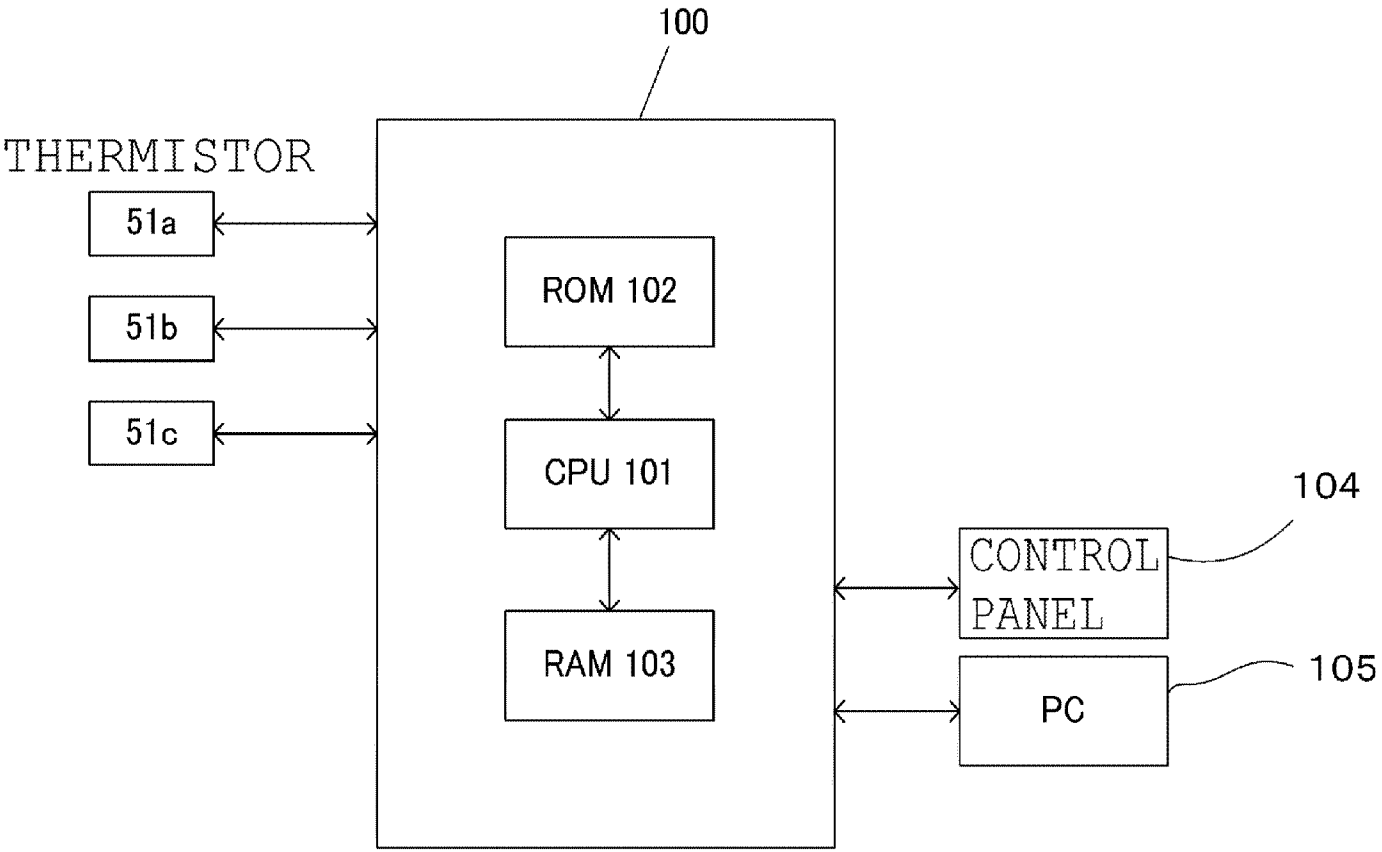
FIG. 10 is a block diagram of a main portion of an electric circuit in Embodiment 1.

A series of these operations are controlled by a control portion 100 included in the image forming apparatus as illustrated in FIG. 10.

The control portion 100 includes a CPU 101 as an arithmetic unit and a ROM 102 and a RAM 103 as a storage unit and processes information according to a predetermined method to control the operation of the image forming apparatus. The features of the present embodiment will be described later.

<Configuration of Fixing Apparatus>

Next, the fixing apparatus will be described with reference to FIGS. 2 to 5.

Figure 2:
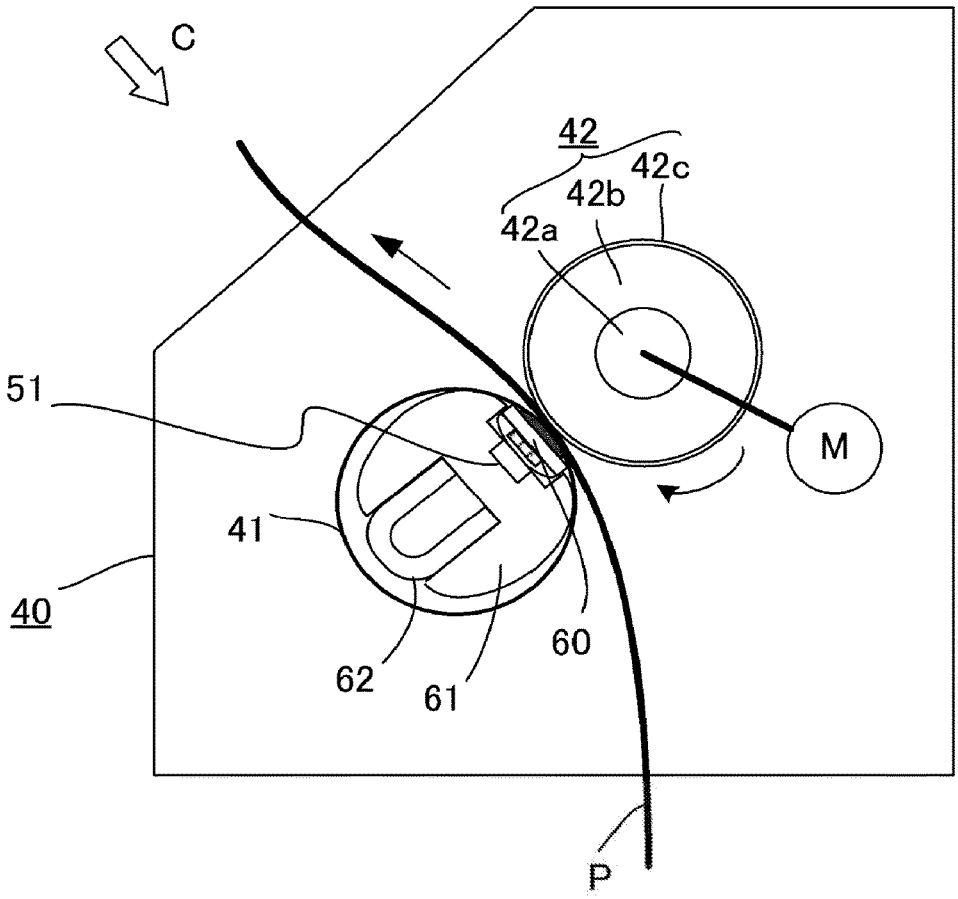
FIG. 2 is a cross-sectional view illustrating a fixing apparatus of FIG. 1 in more detail.

As illustrated in FIG. 2, the fixing apparatus 40 according to the present embodiment is a film heating-type fixing apparatus including a flexible fixing film 41 as a fixing member (heating rotating member) and a pressure roller 42 as a pressure member (backup member) which rotate in a mutually pressure-contacting state. The fixing film 41 is a cylindrical rotating member, and a heater 60 as a heating member makes sliding-contact with an inner circumferential surface of the fixing film 41 to heat the fixing film 41. The heater 60 allows the fixing film 41 to make pressure-contact with the pressure roller 42 whereby a fixing nip portion N is formed. The sheet P as a recording material having a toner image formed thereon is conveyed and passed through the fixing nip portion N whereby the toner image is fixed to the sheet P.

The fixing film 41, the pressure roller 42, and the heater 60 are long members, and a direction orthogonal to the longitudinal direction is a conveying direction of the sheet P.

Figure 3:
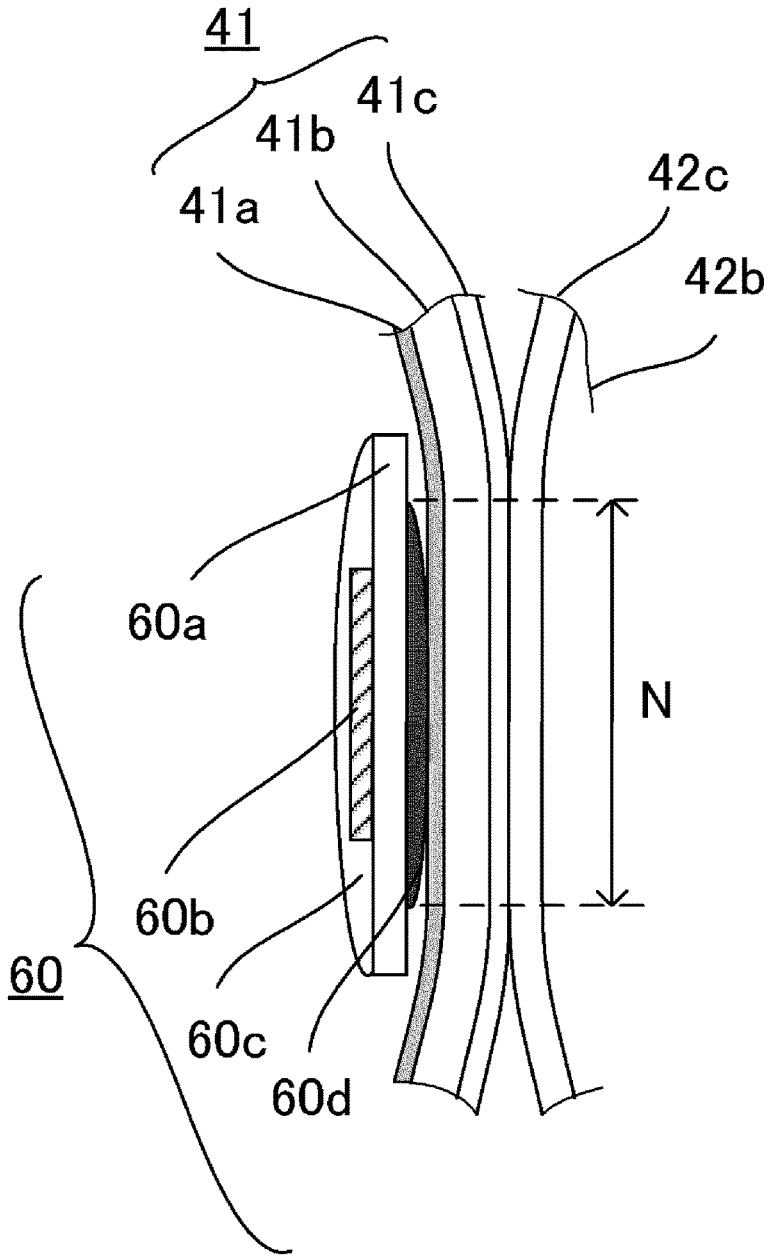
FIG. 3 is an enlarged cross-sectional view of a portion near a nip portion of the fixing apparatus of FIG. 2.

As illustrated in FIG. 3, the fixing film 41 is configured such that an elastic layer 41*b* is formed on an outer circumference of abase layer 41*a* endlessly formed using metal (in the present embodiment, SUS) and a release layer 41*c* formed of a PFA resin is formed on an outer circumference of the elastic layer 42*b*. A layer formed of silicon rubber having high heat conductivity as a base material, for example, is used as the elastic layer 41*b*. The fixing film 41 has a cylindrical shape having an outer diameter of 24 mm and a longitudinal width of 245 mm.

As illustrated in FIG. 2, the pressure roller 42 is configured such that an elastic layer 42*b* is formed on an outer circumferential surface of a cylindrical shaft-shaped core 42*a* formed of metal and a release layer 42*c* is coated on an outer circumferential surface of the elastic layer 42*b*. A conductive silicon rubber layer having a thickness of approximately 3 mm, for example, is used as the elastic layer 42*b*, and a PFA tube having a thickness of approximately 50 μm, for example, is used as the release layer 42*c*. The pressure roller 42 has, for example, an outer diameter of 25 mm and a longitudinal width of 230 mm.

The pressure roller 42 is driven by a driver M so as to rotate at a circumferential speed of 240 mm/sec in the direction indicated by an arrow. The fixing film 41 is rotated at the same speed as the rotating speed of the pressure roller 42 around a heater holder 61 with the force of friction with the pressure roller 42.

The heater 60 has a long substrate 60*a* in a longitudinal direction. The substrate 60*a* is an insulating substrate having good thermal conductivity formed of ceramics such as alumina or aluminum nitrides.

A resistive heat generating layer 60*b* as a heat generating member is formed on a rear surface (the side opposite the fixing film 41) of the substrate 60*a* along the longitudinal direction of the substrate 60*a*. The resistive heat generating layer 60*b* generates heat when current is supplied from both ends thereof by a power supply unit (not illustrated). An insulating glass layer 60*c* has a corrosion preventing function of preventing a change in resistance value due to oxidation or the like of the resistive heat generating layer 60*b* and a function of preventing mechanical damage in addition to a function of overcoating the resistive heat generating layer 60*b* to secure insulation from an external conductive member. A sliding layer 60*d* is provided on a front surface of the substrate 60*a*, making sliding contact with the inner circumferential surface of the fixing film 41 so as to provide the ability to make smooth sliding contact with the inner circumferential surface of the fixing film 41.

The heater 60 is held by the heater holder 61. The heater holder 61 is formed in a cylindrical form having a circular arc shape in a cross-section thereof using a heat-resistant resin, and the fixing film 41 is loosely fitted to an outer circumference thereof. A pressing stay is formed in a U-shape that faces downward in a cross-section thereof using a material such as rigid metal. The pressing stay 62 is disposed inside the fixing film 41 on a side opposite the pressure roller 42 of the heater holder 61.

Figure 5:
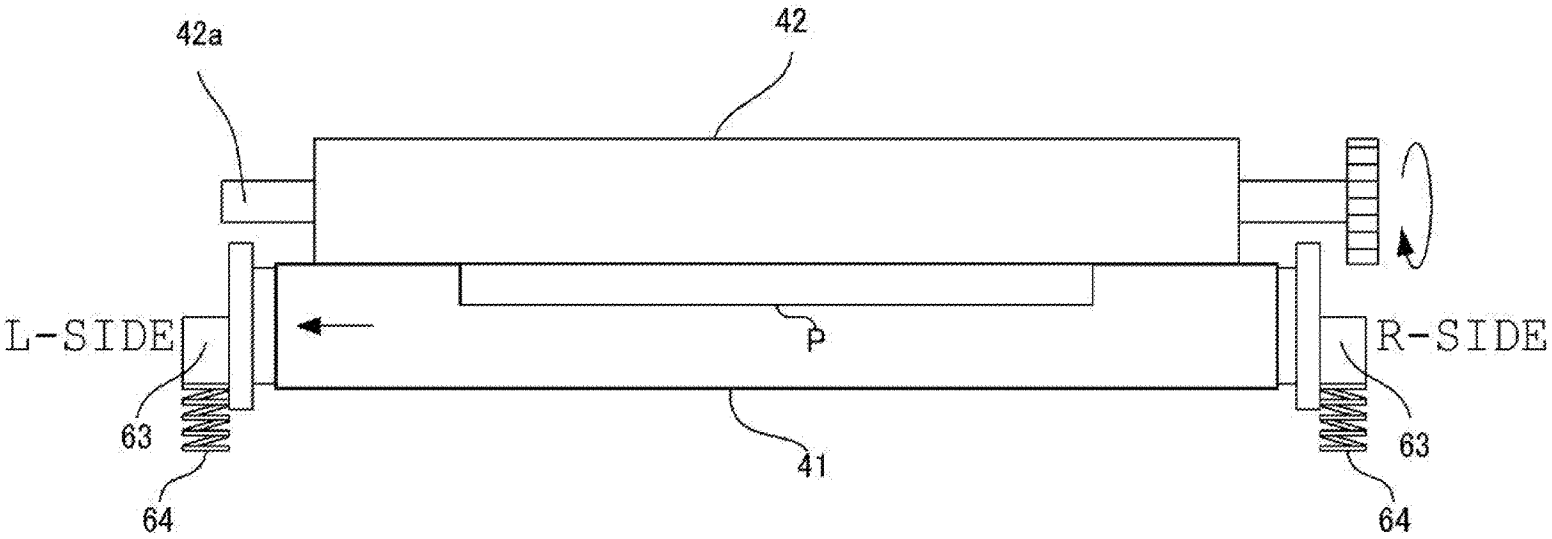
FIG. 5 is a schematic configuration diagram of the fixing apparatus of FIG. 2, seen from a direction indicated by C.

As illustrated in FIG. 5, a flange 63 formed of a heat-resistant resin is fitted to both ends in the longitudinal direction of the fixing film 41. The left and right flanges 63 support both ends of the heater holder 61 and the pressing stay 62 and are pressed toward the pressure roller 42 by a pair of left and right press springs 64 held on the fixing apparatus 40. The flanges 63 are fitted to both left and right ends of the fixing film 41 so as to regulate the orbit in a rotation direction and the ends in the longitudinal direction of the fixing film 41. When the outer circumferential surface of the flange 63 makes sliding contact with the inner circumferential surface of the fixing film 41, the orbit in the detection range of the fixing film 41 is regulated. Moreover, when the fixing film 41 approaches the longitudinal end, the fixing film 41 collides with a convex end surface of the flange 63 whereby the end of the fixing film 41 is regulated.

(Temperature Detecting Member)

Figure 4:
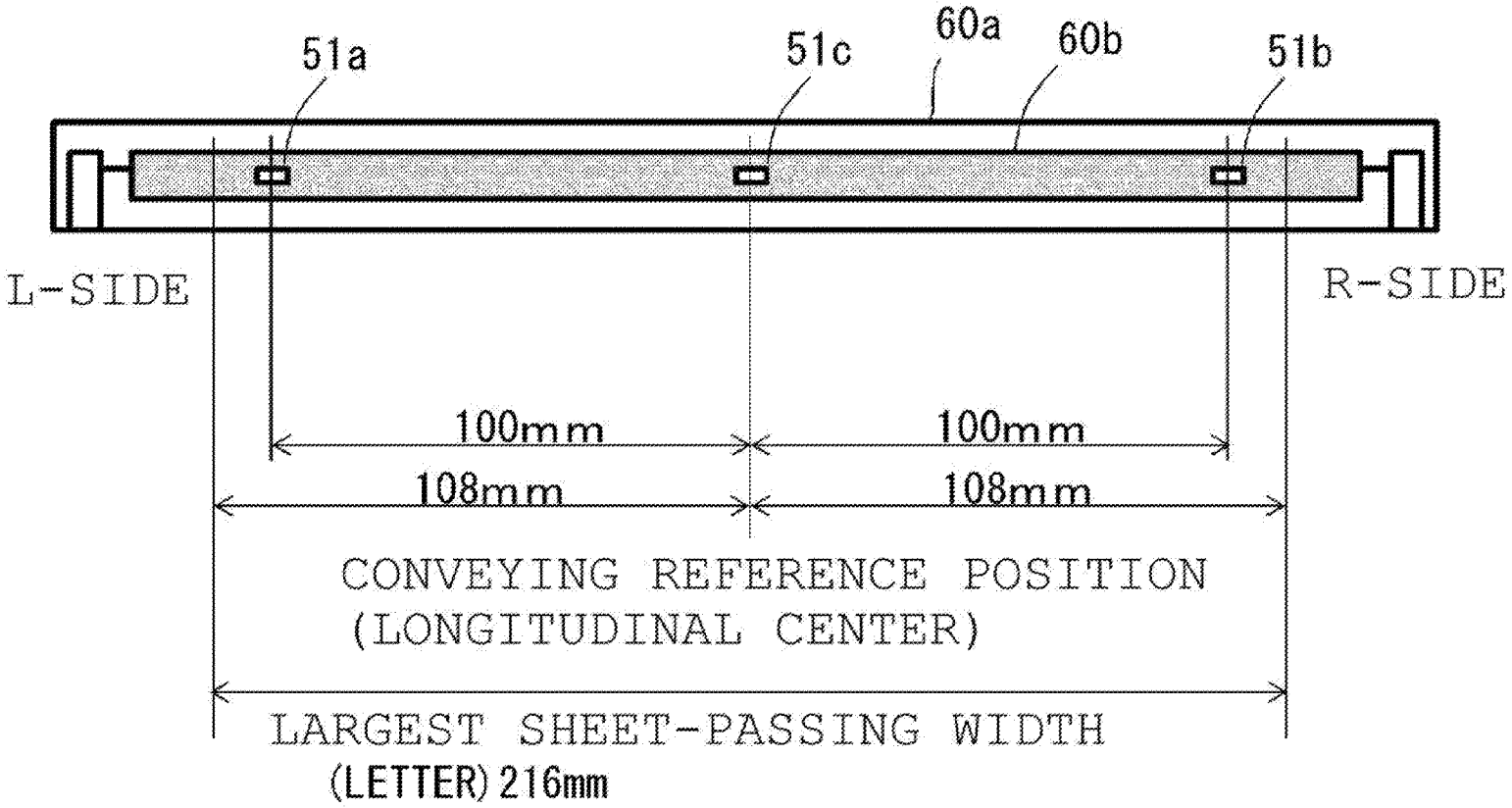
FIG. 4 is a diagram for describing a positional relation between a thermistor and a sheet width in the fixing apparatus of FIG. 2.

As illustrated in FIG. 2, a contact thermistor 51 as a temperature detecting member is provided in the heater 60. As illustrated in FIG. 4, the thermistor 51 is configured to measure the temperature of three non-sliding surfaces of the heater 60 and includes a center thermistor 51*c* positioned at the center and end thermistors 51*a* and 51*b* as a pair of end temperature detecting members positioned at both ends in the longitudinal direction. The center thermistor. 51*c* is a temperature-control thermistor. The electric power supplied to the heater 60 is controlled so that the temperature of the center thermistor 51*c* reaches a target temperature. The end thermistors 51*a* and 51*b* are thermistors for detecting an increase in the temperature of a non-sheet-passing portion. The end thermistor 51*a* (first temperature detecting member) measures the temperature of an L-side end and the end thermistor 51*b* (second temperature detecting member) measures the temperature of an R-side end. The L-side is the side through which the left side of a sheet P passes when a front end in the conveying direction of an image surface to be printed is on the upper side in the drawing and the R-side is the side through which the right side of the sheet P passes.

The end thermistors 51*a* and 51*b* are configured to detect an increase in the temperature of the non-sheet-passing portion when a small-size medium passes, and arrangement positions of the end thermistors 51*a* and 51*b* in the present embodiment are located near and slightly inside a largest sheet-passing width of the present apparatus. That is, the end thermistors 51*a* and 51*b* are disposed near the positions through which both ends of the sheet P, which are both ends of a recording material in a direction orthogonal to the conveying direction of the sheet P are conveyed and passed.

Specifically, when a LETTER-size (hereinafter referred to as LTR) sheet (width: 216 mm) and an A4-size sheet (width: 210 mm) are normally passed through positions located 100 mm outside from an image formation center in the longitudinal direction, the end thermistors 51*a* and 51*b* exhibit a detection temperature substantially equivalent to a control temperature. On the other hand, when a B5-size sheet (width: 182 mm) smaller than an A4-size sheet and an A5-size sheet (width: 148 mm) are continuously passed, an increase in the temperature of a non-sheet-passing portion is detected and control is per formed to decrease the throughput so that the temperature of the non-sheet-passing portion does not increase if the detected temperature is a predetermined temperature or higher.

<Skew or Positional Error Conveying of Recording Material>

The sheet P as a recording material needs to be fed and conveyed appropriately from the sheet feed cassette 21 or the sheet feed tray 26, and as described above, the user needs to operate a regulating plate (not illustrated) so that the sheet P is held at a predetermined position. However, if the operation is not sufficient and the user forgets doing the operation, the regulating plate may not collide with the sheet P. Alternatively, if a number of sheets P larger than a designated number of sheets are set on the sheet feed cassette 21 or the sheet feed tray 26, the amount of loaded sheets P may exceed the height of the regulating plate and the sheets P may not be held by the regulating plate.

The direction of the force that the sheet P receives from the sheet feed roller during sheet-feeding is not always completely identical to the conveying direction. If the position of the regulating plate is shifted, since the ends of the sheet P are not held, the sheet P may start skew. As another example, if the ends of the sheet P are not held by the regulating plate due to overloading of the sheet P and the surface of the sheet P rubs against an unintended position, the sheet P may skew. For example, when the surface of the sheet P rubs against only one side in the longitudinal direction and receives a load, since rotational force is applied to the sheet P, the sheet P skews.

When the amount of skew of the conveyed sheet P is small, although the skew is corrected by the registration roller pair 23, there is a limit on the amount of skew that can be corrected by the registration roller pair 23. When large skew occurs in the sheet P during sheet-feeding, the skew is not sufficiently corrected by the registration roller pair 23 but the sheet P is conveyed to the secondary transfer nip portion 37 in a state of being tilted in relation to a sheet-passing direction and is then passed through the fixing apparatus 40 and discharged onto the sheet discharge tray 44. When the amount of skew is much larger, since the sheet P is conveyed in a state of protruding from an intended sheet-passing area, a paper jam may occur in the conveying path before the sheet P is discharged and the ends of the sheet P may be damaged.

Alternatively, if the regulating plate is shifted and the center in the width direction of the sheet P is set in a state of being shifted from a reference conveying position in the width direction of the sheet, so-called positional error conveying may occur. In the case of the positional error conveying, a temperature decrease of the non-sheet passing portion, in a side to which the sheet shifts in the width direction, may occurs and a excessive temperature rise of the non-sheet passing portion, in a side opposite to the side to which the sheet shifts in the width direction, may occurs. Moreover, when a temperature difference occurs in the longitudinal direction, the fixing film 41 may receive strong biasing force in the longitudinal direction due to, for example, a longitudinal difference in the expansion of the rubber layer of the fixing film 41 and the pressure roller 42 and the fixing film 41 may collide with the flange 63. If this phenomenon occurs repeatedly, the durability of the SUS layer may decrease. Further, the temperature difference in the longitudinal direction may result in a longitudinal unevenness in the deterioration of the rubber layer of the fixing film 41 and the pressure roller 42, and the conveying balance in the longitudinal direction may be lost, which may cause problems such as wrinkles in the sheet P. The present invention prevents the above-described problems and a method for preventing the same will be described in detail.

<Skew or Positional Error Conveying Determining Method>

Next, a method of determining conveying faults such as skew or positional error conveying, which is the feature of the present invention, will be described.

In the present embodiment, as described above, a change in the longitudinal temperature difference of the fixing film 41 is indirectly detected from the detection results of the end thermistors 51*a* and 51*b* disposed at both ends in the longitudinal direction of the heater 60 to detect skew or positional error conveying of the sheet P.

Figure 6:
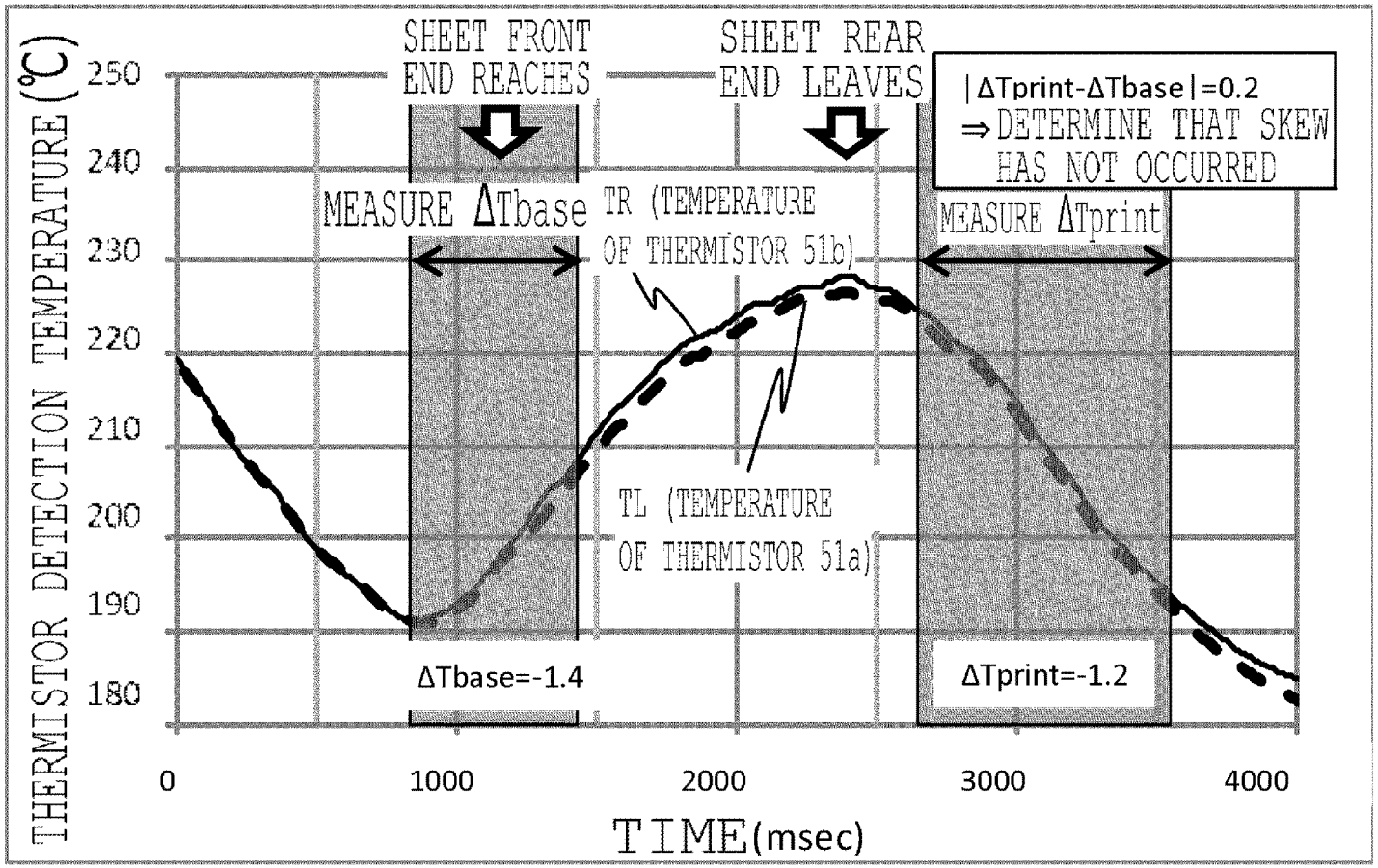
FIG. 6 is a diagram for describing a change in the temperature of an end thermistor during normal sheet-passing.
Figure 7:
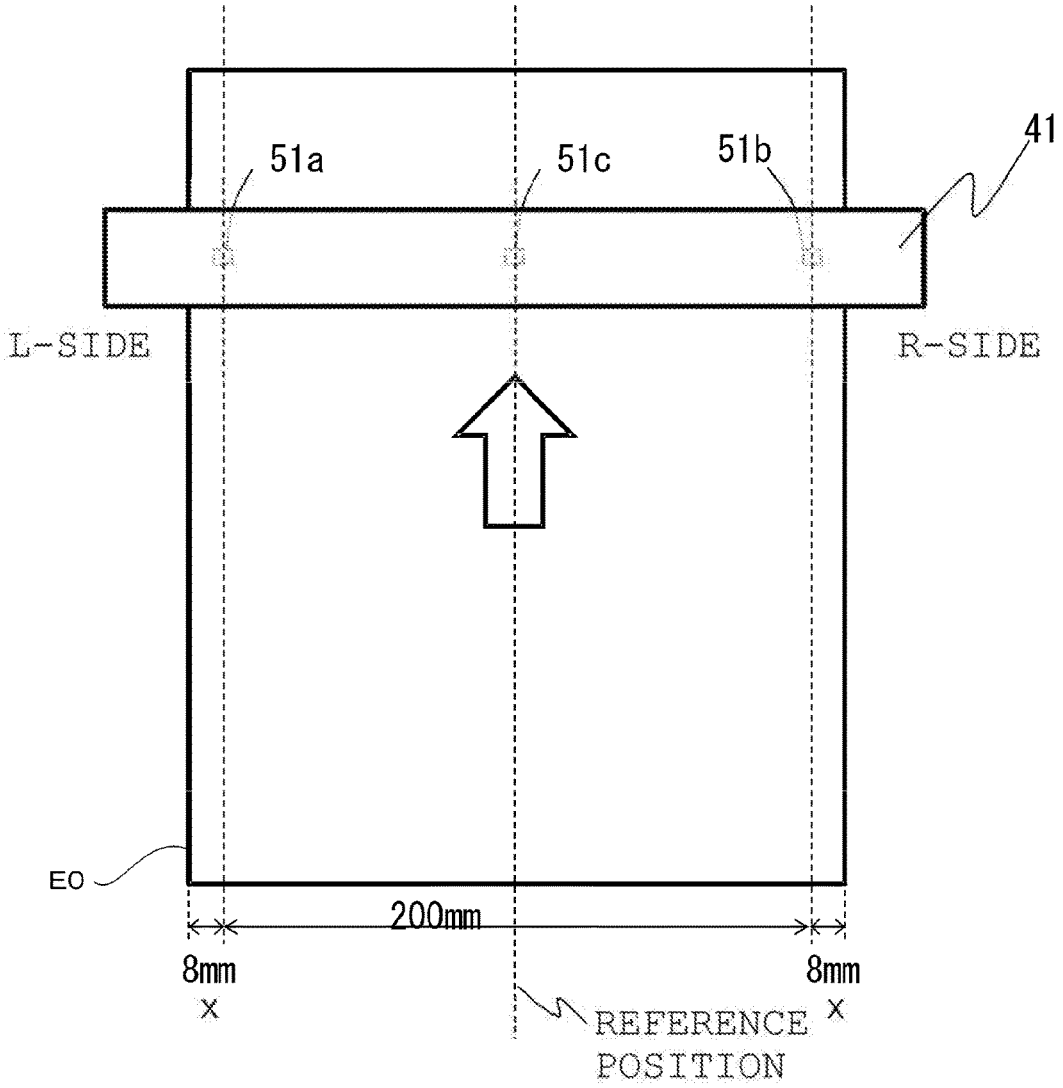
FIG. 7 is a diagram for describing a positional relation between an end thermistor and a sheet during normal sheet-passing in Embodiment 1.

FIG. 6 illustrates a change in the detection temperatures of the end thermistors 51*a* and 51*b* when one LTR-size sheet P (largest sheet-passing width: 216 mm) is correctly set on the sheet feed tray 26 and is normally passed. FIG. 7 illustrates a positional relation between the sheet P and the fixing film 41 of the fixing apparatus 40 during sheet-conveying in the above case. Since no skew occurs in this sheet-passing, a difference between the detection temperatures of the end thermistors 51*a* and 51*b* is always small. ΔTbase and ΔTprint in FIG. 6 will be described later.

Figure 8:
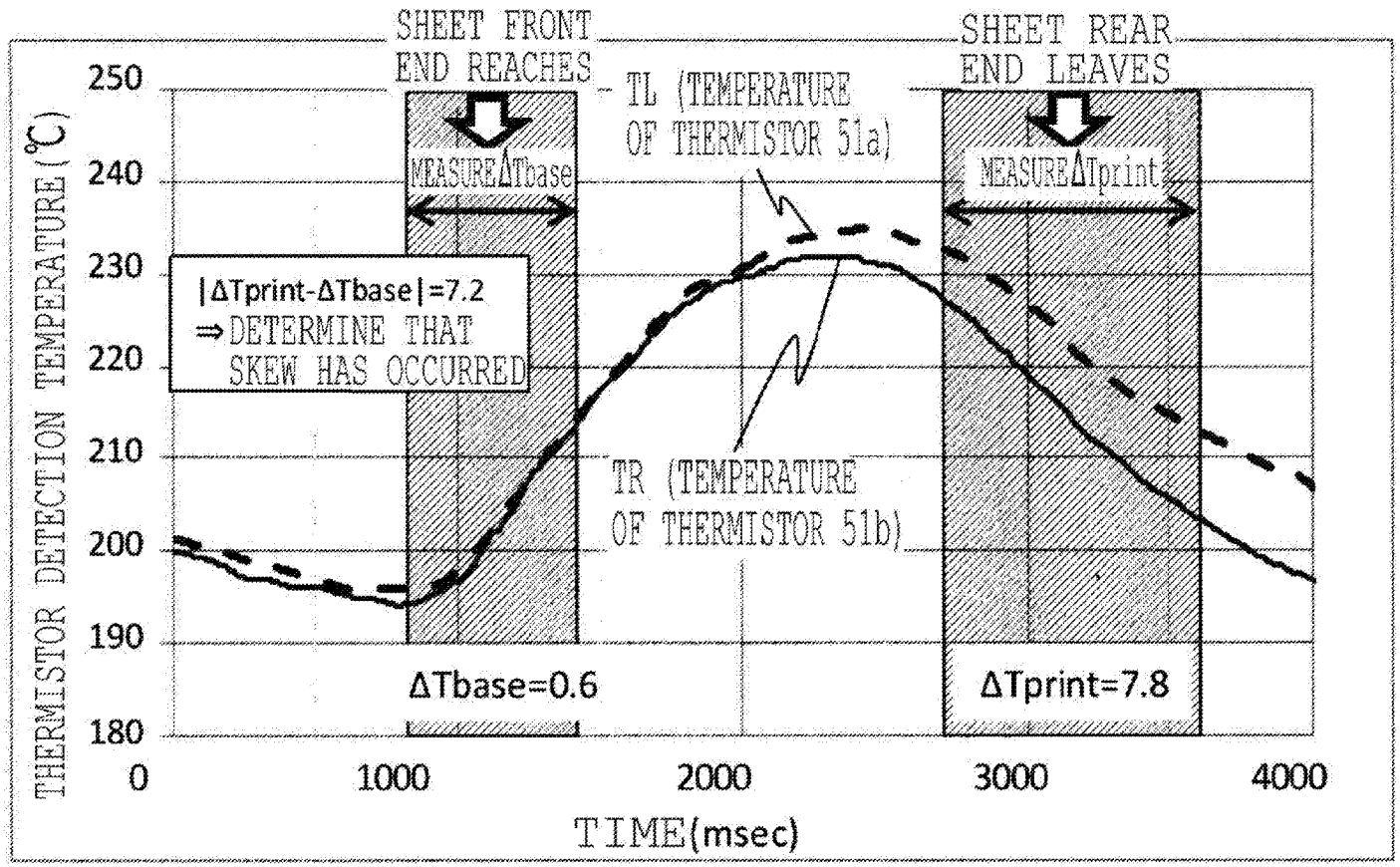
FIG. 8 is a diagram for describing a change in the temperature of an end thermistor during sheet skew in Embodiment 1.
Figure 9:
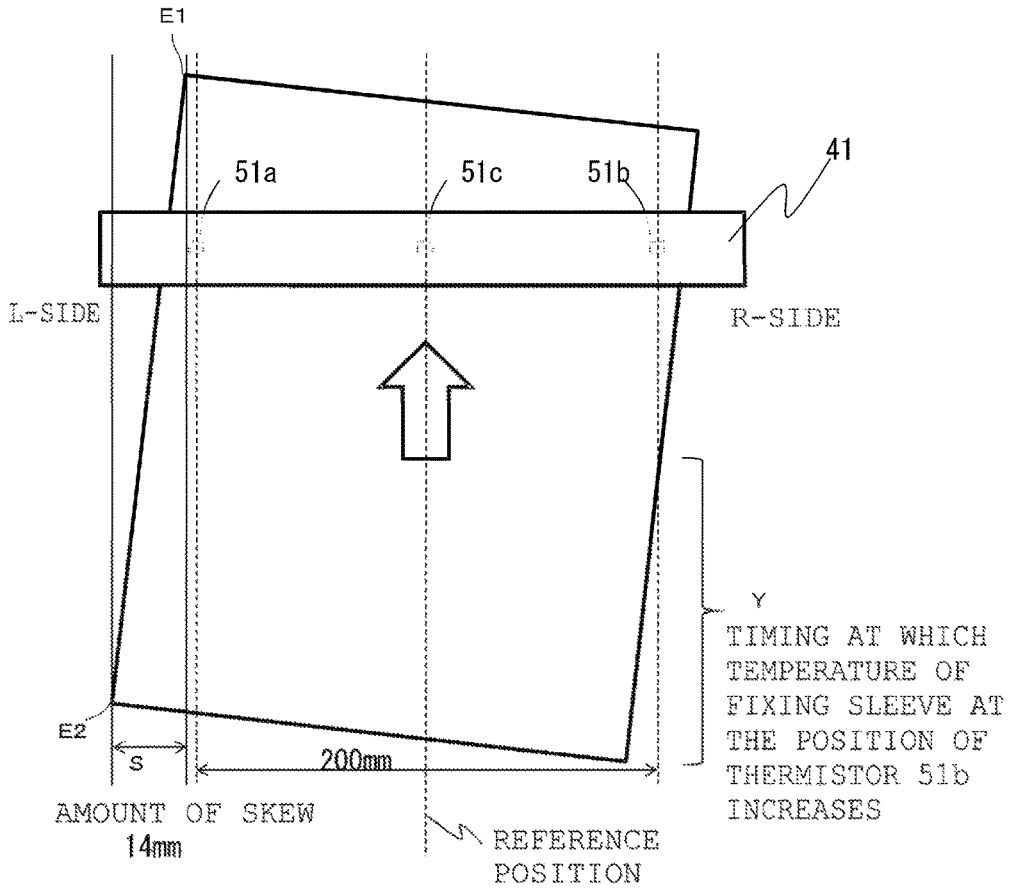
FIG. 9 is a diagram for describing a positional relation between an end thermistor and a sheet during sheet skew in Embodiment 1.

Next, FIG. 8 illustrates the detection temperatures of the end thermistors 51*a* and 51*b* when the same LTR-size sheet P is overloaded and set on the sheet feed tray in a state in which both ends in the longitudinal direction are free (not regulated) and the sheet P is passed in a skewed state. FIG. 9 illustrates a positional relation between the sheet P and the fixing film 41 of the fixing apparatus 40 when the sheet P skews. As illustrated in FIG. 9, the amount of skew S is defined by the amount of a rear end E2 of the sheet P as a rear end of a recording material, approaching the L side in relation to a front end E1 of the sheet P as a front end of the recording material. In the illustrated example, the amount of skew S is 14 mm.

If skew is not present, the distance X between a side edge E0 of an LTR-size sheet P and the end thermistor 51*a* or 51*b* is 8 mm. However, if skew of which the amount of skew S is as large as 14 mm occurs, the sheet P may approach the L side. In this case, in an area Y extending from an intermediate portion of a sheet P to the rear end of the sheet P, the sheet P at the position of the R-side end thermistor 51*b* does not absorb the heat of the fixing film 41. As a result, the temperature of the fixing film 41 on the R side increases and a temperature difference ΔT (in this example, 7.8° C.) occurs in the detection temperatures of both end thermistors 51*a* and 51*b*.

Conventionally, although skew or positional error conveying of the sheet P has been detected based on the temperature difference ΔT, the skew or positional error conveying detection accuracy is not high. The reasons therefor will be described below.

Figure 11:
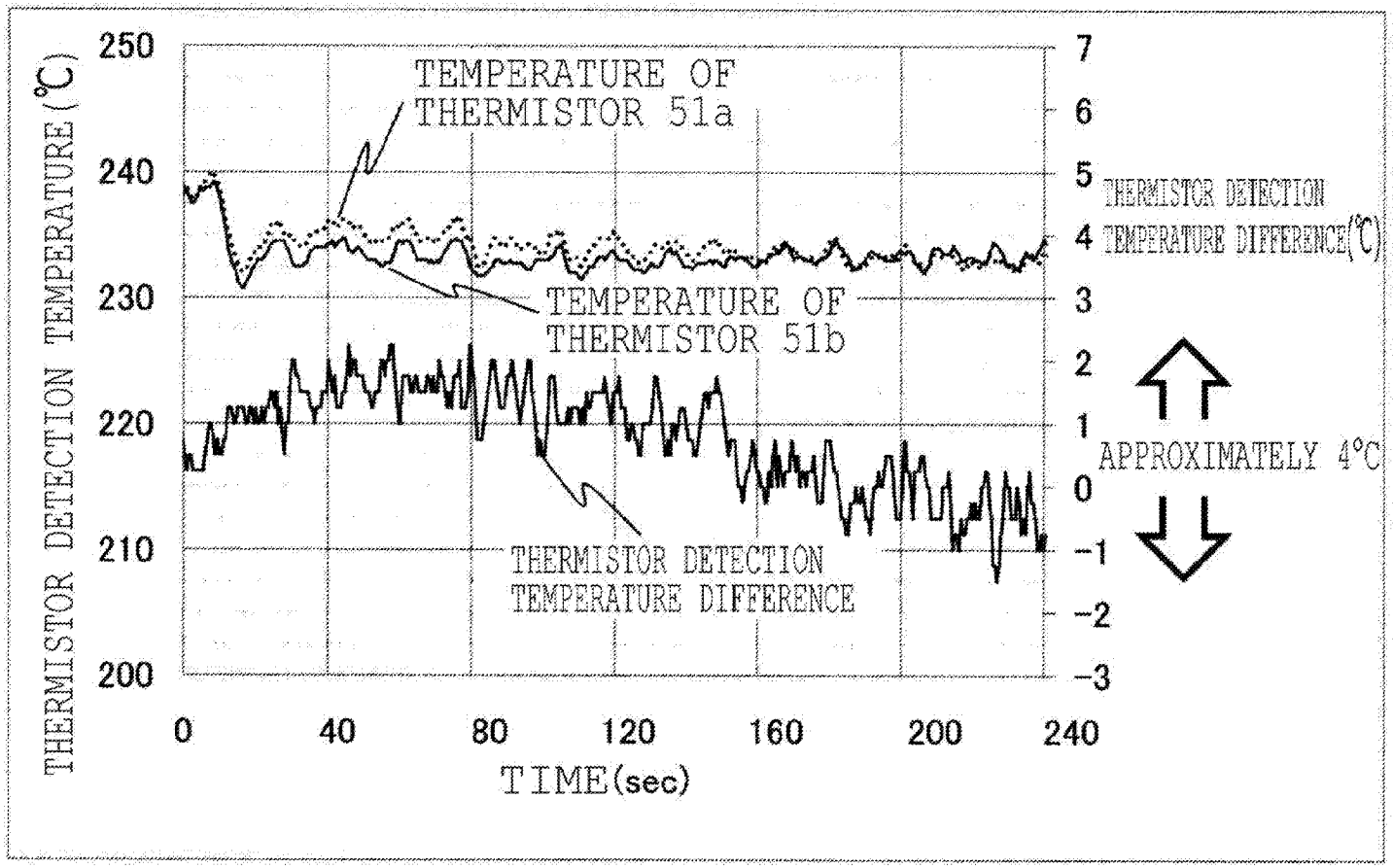
FIG. 11 is a diagram for describing a detection temperature difference of an end thermistor during normal continuous sheet-passing in Embodiment 1.

FIG. 11 illustrates an example of a change in detection temperatures of the end thermistors 51*a* and 51*b* when 160 sheets are continuously passed without skew from a state in which the fixing apparatus is cooled. It can be understood that, even when sheets are passed without skew, a detection temperature difference ΔT between the end thermistors 51*a* and 51*b* changes approximately by 4° C. during passing of 160 sheets. Although an example of a change in the detection temperature difference between the end thermistors 51*a* and 51*b* in a short period during a single continuous job has been illustrated, a detection temperature difference between the end thermistors 51*a* and 51*b* occurring due to durability deterioration resulting from a long period of use of the apparatus also changes.

The detection temperature difference between the end thermistors 51*a* and 51*b* occurs due to various factors such as a temperature unevenness in the longitudinal direction within the apparatus, a sensitivity fluctuation of thermistors, positional error conveying of the sheet P in the longitudinal direction resulting from fluctuations in components and assembling of the image forming apparatus, or a variation in the detection temperature resulting from durability deterioration of members. In order to accurately detect skew based on a temperature difference of several ° C. in the longitudinal direction occurring due to skew of the sheet P, a temperature difference of several ° C. in the longitudinal direction occurring during normal sheet-passing is not negligible.

That is, it is necessary to understand the state of the fixing apparatus at the start of sheet-passing in order to accurately detect skew. Thus, the temperature difference in the longitudinal direction at the timing at which the front end of the sheet P reaches (passes) the fixing nip portion N is measured.

In the present embodiment, skew or positional error conveying of the sheet P is determined based on the degree of change in the temperature difference in the longitudinal direction of the fixing apparatus 40 before and after passing of the sheet P.

Figure 12:
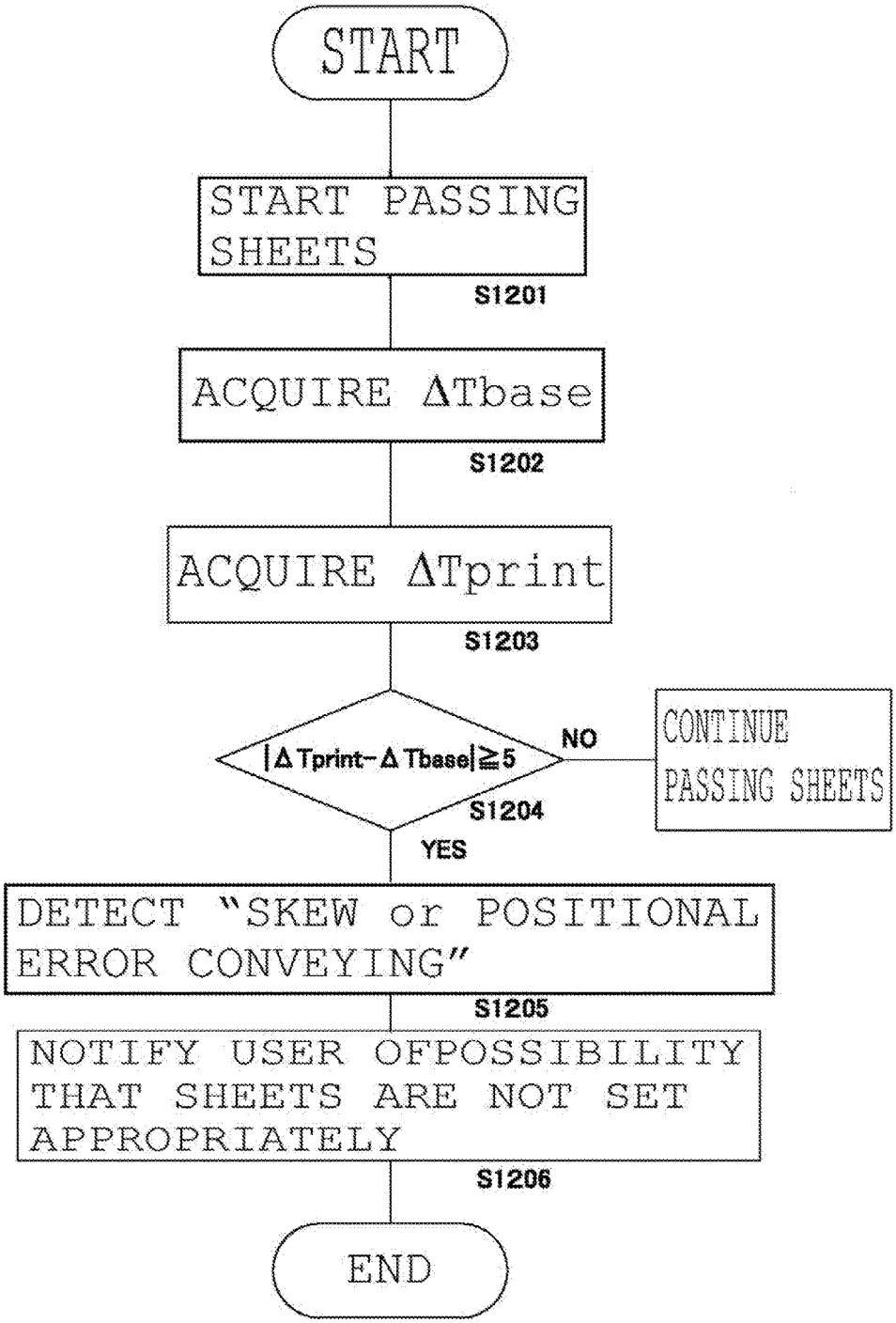
FIG. 12 is a flowchart for describing a conveying state determining process in Embodiment 1.

Hereinafter, a conveying state determining method according to Embodiment 1 will be described in detail according to the flowchart of FIG. 12.

After printing starts (S1201), at the timing at which the front end of the sheet P reaches (passes) the fixing nip portion N, a first detection temperature difference ΔTbase is acquired from the detection temperatures of the pair of end thermistors 51*a* and 51*b* (S1202). Subsequently, at the timing at which the rear end of the sheet P passes the fixing nip portion N, a second detection temperature difference ΔTprint is acquired from the detection temperatures of the pair of end thermistors 51*a* and 51*b* (S1203).

The timing at which the front end of the sheet P reaches the fixing nip portion N is the timing occurring before and after the front end of the sheet P reaches the fixing nip portion N and is the timing occurring before the influence of the heat of the fixing film 41 being absorbed by the sheet P at the fixing nip portion N is clearly detected by the end thermistors 51*a* and 51*b* as a temperature. That is, the timing may be the timing at which the detection temperature of the center thermistor 51*c* reaches a target temperature even when the front end of the sheet P has not reached the fixing nip portion N.

Similarly, the timing at which the rear end of the sheet P leaves the fixing nip portion N is the timing occurring before and after the rear end of the sheet P leaves the fixing nip portion N and is the timing at which the influence of the heat of the fixing film 41 being absorbed by the sheet P is reflected to the largest extent on the detection temperatures of the end thermistors 51*a* and 51*b* as a temperature.

In the present embodiment, the timing at which the front end of the sheet P, which is the front end of a recording material reaches the fixing nip portion N is defined as a predetermined period (for example, 0.3 sec each (0.6 sec in total)) before and after the front end of the sheet P starts entering the fixing nip portion N. Using average temperatures TLin and TRin of the end thermistors 51*a* and 51*b* in this period, the first detection temperature difference ΔTbase which is a lateral temperature difference is defined as follows.

$$\Delta T\text{base}=TL\text{in}-TR\text{in} \quad \text{(Expression 1)}$$

Similarly, the timing at which the rear end of the sheet P, which is the rear end of a recording material leaves the fixing nip portion N is defined as a period of 0.9 sec which starts 0.3 sec after and ends 1.2 sec after the rear end of the sheet P leaves the fixing nip portion N. Using average temperatures TLout and TRout of the end thermistors 51*a* and 51*b* in this period, the second detection temperature difference ΔTprint which is a lateral temperature difference is defined as follows.

$$\Delta T\text{print}=TL\text{out}-TR\text{out} \quad \text{(Expression 2)}$$

In the configuration of the present embodiment, even when subsequent sheets are printed in continuous sheet-passing, for example, it was understood that the influence of a temperature increase of the fixing film 41 resulting from skew or positional error conveying was large in the period (that is, the period of approximately 1.2 sec) in which the fixing film 41 makes four rotations after the rear end of the sheet P passed the fixing nip portion N. The second detection temperature difference ΔTprint is measured at the above-described timing.

In the present embodiment, the first detection temperature difference ΔTbase and the second detection temperature difference ΔTprint are calculated based on an average temperature in a predetermined period. However, the detection temperature difference may be another calculation value such as a largest value in a period, for example, as long as the value indicates a longitudinal temperature difference of the fixing apparatus 40.

Here, TL indicates a detection temperature of the end thermistor 51*a*, TR indicates a detection temperature of the end thermistor 51*b*, and the temperatures at the timing when the sheet P reaches the fixing nip portion are TLin and TRin. Moreover, the temperatures at the timing when the rear end of the sheet P leaves the fixing nip portion are TLout and TRout.

A difference |ΔTprint−ΔTbase| between the first detection temperature difference ΔTbase and the second detection temperature difference ΔTprint obtained according to the above-described flow is calculated, and the calculated difference is compared with a detection threshold V which is a predetermined reference value to determine a conveying state.

Specifically, the conveying state is determined based on the following conditional expression (S1204).

$$|\Delta T\text{print}-\Delta T\text{base}|\geq V \text{ (for example, 5° C.)}$$

In this example, the detection threshold V is set to 5 (° C.) and it is determined that the conveying state of the sheet P is abnormal if the conditional expression is satisfied (that is, when the difference between the first detection temperature difference ΔTbase and the second detection temperature difference ΔTprint is equal to or larger than the detection threshold V (5° C.). That is, it is determined that skew or positional error conveying has occurred in the sheet P (S1205).

Further, when skew or positional error conveying is present, a notification that there is a possibility that the set state of the sheet on the cassette 21 or the tray 26, which is a recording material holding state, is not appropriate is sent to the user (S1206). As illustrated in FIG. 10, the notification to the user is sent in such a way that a notification signal from a control portion 100 is output and is displayed, for example, on a display portion of a control panel 104. In any case, it is sufficient that the user can be notified, and an audible sound may be issued, and any alarm may be output.

As illustrated in FIG. 8, in the present embodiment, when skew occurs in the sheet P and the amount of skew S is 14 mm, since ΔTbase=0.6 and ΔTprint=7.8, the difference |ΔTprint−ΔTbase|=7.2° C., and skew of the sheet P can be detected.

The sheet P used in this example is a sheet having a basis weight of 75 g/m$^2$ (product of Xerox Corporation, product name: "business Multipurpose 4200").

In the above description, a change in the detection temperature difference between the end thermistors 51*a* and 51*b* occurring when the amount of skew S is 14 mm has been described as an example. However, in the configuration of the present embodiment, skew was detected when the amount of skew was 9 mm or larger, and the larger the amount of skew S, the higher the frequency at which the apparatus detected skew of the sheet.

[Sheet Size and Determination Criteria]

As described above, the easiness to detect skew depends on the relation between an end position of the sheet P and the position of the end thermistor 51*a* and 51*b*. Thus, the easiness to detect skew is different depending on a sheet size. In the present embodiment, although a case of passing an LTR-size sheet has been described, the effect of the present embodiment is not limited to a case where a sheet P of a specific size is passed.

For example, skew of a sheet can be determined when a change in a temperature difference in the longitudinal direction reaches a predetermined detection threshold or larger regardless of the sheet size. As an example, skew was detected for an A4-size sheet, approximately 6 mm narrower than the LTR-size sheet, when the amount of skew was approximately 6 mm.

Moreover, different skew detection values which are reference values may be set for respective sheet sizes, and skew detection may be performed at the same amount of skew S regardless of the sheet size. For example, when a skew detection value for detecting skew of an LTR-size sheet is 5° C., the skew detection value for an A4-size sheet may be set to 7.5° C. so that skew of a sheet can be detected when skew of approximately 9 mm occurs in the A4-size sheet similarly to the LTR-size sheet.

[Sheet Basis Weight and Determination Criteria]

Moreover, a change in the temperature difference in the longitudinal direction is different depending on a basis weight of the sheet P even at the same amount of skew. The larger the basis weight, the larger the change whereas the smaller the basis weight, the smaller the change. The amount of heat required for fixing toner is different depending on factors such as the basis weight or the surface property of a sheet. It is common to adjust a process speed of image formation or a fixing control temperature depending on a sheet basis weight or type to secure the fixing performance of toner to respective sheets. When the fixing performance of sheets having different basis weights is secured at the same process speed, the amount of applied heat is secured in such a way that the larger the basis weight of a sheet, the higher the control temperature. Thus, the amount of heat supplied to a sheet having a large basis weight per unit area or unit time is larger than that of a sheet having a small basis weight.

As a result, when a sheet P is passed in a skewed or a positional error conveyance, since the sheet does not pass the position of a thermistor on one side in the longitudinal direction in which the temperature increases. Thus, the higher the basis weight of the passing sheet, the higher the temperature increase. This is the same phenomenon as that known as a general temperature increase in a non-sheet-passing portion.

Thus, the detection threshold V may be adjusted according to the basis weight of a medium used in such a way that the detection threshold V for a thick sheet having a large basis weight in which a temperature difference in the longitudinal direction is likely to occur due to sheet skew is set to be larger than that of a thin sheet in order to prevent detection errors.

[Sheet Surface Property and Determination Criteria]

Similarly, the surface property of a sheet P also has an influence on the toner fixing performance, and the control temperature may be increased for a sheet medium having a coarse surface property. Similarly to the case of the basis weight, the detection threshold V may be set to be large for a medium having a coarse surface property. The basis weight and the surface property may be determined based on a value set by the user and may be determined by a medium detection sensor (not illustrated) or the like included in the main body.

[Sheet Type-Based Control Example]

The operation of the image forming apparatus according to the present embodiment will be described as an example.

The image forming apparatus of the present embodiment has a normal sheet print mode, a thin normal sheet print mode, a thick normal sheet print mode, and a bond sheet print mode depending on a sheet type. The normal sheet has a supposed basis weight of 75 to 80 g/m$^2$, the thin normal sheet has a supposed basis weight of approximately 60 g/m$^2$, and the thick normal sheet has a supposed basis weight of approximately 100 g/m$^2$. The control temperature of the thin normal sheet print mode is 15° C. lower than the control temperature of the normal sheet print mode and the control temperature of the thick normal sheet print mode is 15° C. higher than the control temperature of the normal sheet print mode. Moreover, the control temperature of the bond sheet print mode is 15° C. higher than the control temperature of the normal sheet print mode.

In the present embodiment, respective print modes have different detection thresholds V as determination criteria values so that skew can be detected approximately at the same amount of skew S for the sheet of the same size regardless of the basis weight. As described above, the skew detection value of the normal sheet print mode is set to 5° C., the detection threshold V of the thin normal sheet print mode is set to 4° C., and the detection threshold V of the thick normal sheet print mode is set to 6.5° C. Further, the detection threshold V of the bond sheet print mode is set to 6.5° C. so that skew of 9 mm can be detected in the LTR-size sheet.

[Measurement Timing of First Detection Temperature Difference ΔTbase]

In the present embodiment, the measurement timing of the first detection temperature difference ΔTbase is set to the timing at which sheet-passing temperature control is performed before and after the sheet P reaches the fixing nip portion N as described above. This is because the temperature difference between the end thermistors 51*a* and 51*b* is relatively stable in this period. In the present embodiment, the sheet-passing temperature control starts 0.3 sec (a period taken for the fixing film 41 to make approximately one rotation) before the front end of the sheet P reaches the fixing nip portion N, and this timing is set to the measurement start point of the first detection temperature difference ΔTbase.

An acquisition stop timing of the first detection temperature difference ΔTbase may be the timing at which the front end of the sheet P reaches the fixing nip portion N and the measurement period is preferably long within a range in which the temperature of the heater 60 is relatively stable. In the configuration of the present embodiment, the timing at which the fixing film 41 makes approximately one rotation after the front end of the sheet P reaches the fixing nip portion N is set to the measurement ending point of ΔTbase.

Heat transfer from the fixing film 41 to the sheet P is performed locally at the fixing nip portion N having a width of approximately 9 mm. The influence of the heat of the fixing film 41 being transferred to the sheet P appears in the detection temperatures of the end thermistors 51*a* and 51*b* when the fixing film 41 makes approximately one rotation after the sheet P reaches the fixing nip portion N. Thus, the measurement ending timing of ΔTbase is set as described above.

[Measurement Timing of ΔTprint]

On the other hand, the measurement timing of the second detection temperature difference ΔTprint is set to the timing at which the passing of the sheet P through the fixing nip portion N is likely to affect the detection temperatures of the end thermistors 51*a* and 51*b*. Since the amount of skew or positional error conveying of the sheet P is not constant, the timing at which the temperature increase in the fixing film 41 starts influencing the detection temperatures of the end thermistors 51*a* and 51*b* is not constant. However, the influence of skew or positional error conveying of the sheet P starts appearing in the detection temperatures of the end thermistors 51*a* and 51*b* when the fixing film 41 makes one rotation (approximately 0.3 sec) after the sheet P passes the fixing nip portion N. Moreover, even when the sheet P passed subsequently is not skewed or conveyed with positional error, the influence of the temperature increase of the previous sheet-passing remains during the period in which the fixing film 41 makes one rotation. Further, the thermal conductivity of respective members may cause a delay in reflection of the temperature increase of the fixing film 41 resulting from skew or positional error conveying of the sheet P on the detection temperatures of the end thermistors 51*a* and 51*b*.

These characteristics change according to the constituent elements of the fixing apparatus 40 and the materials thereof. These measurement timings are set in order to detect a change in the first and second detection temperature differences before and after the sheet P passes the fixing nip portion. The acquisition timings of the first and second detection temperature differences ΔTbase and ΔTprint can be determined according to the constituent elements and the materials thereof as long as the object is attained.

[Control Block Configuration]

FIG. 10 is a block diagram illustrating main portions of an electric circuit of the image forming apparatus. The series of operations based on the flowchart of FIG. 12 are executed by the control portion 100, and the control portion 100 is a determining unit of the present application invention.

The end thermistors 51*a* and 51*b* are connected to the control portion 100 that controls the operation of the image forming apparatus. Regarding detection of skewed or positional error conveying, the central processing unit (CPU) 101 in the control portion 100 perform a predetermined arithmetic operation on the temperature information detected by the end thermistors 51*a* and 51*b*.

The arithmetic operation result is temporarily stored in the RAM 103 as a storage unit and is compared with the detection threshold V as a reference value for determining skew or positional error conveying, stored in advance in the ROM 102 which is a storage unit inside the control portion 100. When it is determined that skew or positional error conveying has occurred, the control portion 100 outputs signals to the control panel 104 of the apparatus or a computer 105 so that the user can be informed of the fact that the sheets are not set properly. For example, the operation process is performed based on the flowchart of FIG. 12.

Moreover, information about skew or positional error conveyance may be stored in the computer 105 or a memory inside the image forming apparatus together with data indicating the occurrence timing and the use state of the image forming apparatus as well as outputting the signals.

In the present embodiment, a case in which the first detection temperature difference ΔTbase and the second detection temperature difference ΔTprint are obtained for each recording material (that is, whenever one sheet P passes) and an arithmetic operation is performed thereon to determine a conveying state such as skew or positional error has been described. The measurement timings of the first and second detection temperature differences and the detection threshold which is reference determination criteria for determining skew or positional error conveying are determined according to the apparatus configuration.

Moreover, the detection thresholds serving as the determination criteria are not limited to the above-described values but may be set so as to further reduce determination errors.

In Embodiment 1, although the user is notified of the possibility that the set state of the sheet P is not proper, the notification may be stored in the memory of the image forming apparatus rather than sending the notification to the user. Alternatively, printing may be forcibly stopped as well as sending the notification because there is a risk of image defects or a paper jam of the sheets P.

[Positional Relation Between Sheet Size and End Thermistors 51*a* and 51*b*]

In the present embodiment, although the end thermistors 51*a* and 51*b* at both longitudinal ends are arranged at positions closer to the center by a predetermined amount X (for example, 8 mm) in relation to the largest sheet-passing width of the apparatus, the arrangement position is not limited to this. The skew or positional error conveying detection described in the present embodiment is performed based on whether the amount of heat of the fixing film 41 at the arrangement position of the end thermistors 51*a* and 51*b* is absorbed by the sheet P or a longitudinal detection temperature difference occurring due to a difference in the temperature increase of the non-sheet-passing portion resulting from the sheet P being shifted from the reference position. Thus, from the perspective of skew or positional error conveying detection, higher detection sensitivity is obtained when the end thermistors are located closer to the end position in the width direction of the target sheet P. That is, by doing so, the longitudinal detection temperature difference occurring when the sheet P is skewed or conveyed with positional error increases and skew determination can be performed even when the amount of skew is small.

On the other hand, the object of arranging the end thermistors 51*a* and 51*b* at both longitudinal ends is to detect a temperature increase in the non-sheet-passing portion during passing of small-size sheets. Thus, the arrangement position may be determined by taking the balance with the arrangement position of the end thermistors 51*a* and 51*b* aiming to detect the temperature increase in the non-sheet-passing portion into consideration. In the present embodiment, in order to accurately detect the temperature increase in the non-sheet-passing portion when a sheet (medium) having a smaller width than the A4-size sheet, the end thermistors 51*a* and 51*b* at both ends are arranged closer to the center than the width of the A4-size sheet. Since it is difficult to detect the temperature increase of the non-sheet-passing portion of a sheet (medium) having a larger width than the A4-size sheet, the length of the heater 60 is adjusted to suppress a temperature increase in the non-sheet-passing portion as much as possible while securing the fixing performance at the end of a large-width sheet (medium) such as the A4-size or LTR-size sheet.

Although a configuration in which the end thermistors 51*a* and 51*b* make contact with the non-sliding surface of the heater 60 has been described, the advantage of the present invention is obtained in a configuration in which, for example, the end thermistors 51*a* and 51*b* make contact with the inner surface of the fixing film 41 as described above or the temperature is measured in a non-contacting manner from the front surface side.

That is, the present invention can be applied to a fixing apparatus which uses a heat source other than a ceramic heater (for example, a known heat roller-type fixing apparatus which uses a halogen heater, a direct heating-type fixing apparatus that directly heats the outer circumferential surface of a fixing member, or an induction heating-type fixing apparatus). Since the period taken until the temperature of the fixing film 41, the pressure roller 42 or the like is reflected on the detection temperature of the temperature detector is different depending on a configuration, the measurement timing may be adjusted in respective configurations. Although an example in which the arrangement in the longitudinal direction of thermistors is symmetrical about a reference conveying position of the sheet P has been described, the arrangement positions are not limited to the symmetrical positions but may be asymmetrical as long as the terminal devices before and after sheet-passing are compared as in the present embodiment.

In the present embodiment, although ΔTbase is acquired whenever one recording material is passed, the temperature of the fixing film 41 may be detected directly, for example. When the temperature is detected directly, the measurement period of ΔTbase may decrease and the measured ΔTbase may become unstable slightly. In such a case, ΔTbase may be an average of latest several sheets.

Embodiment 2

Next, Embodiment 2 of the present invention will be described.

In Embodiment 2, a difference between the first detection temperature difference and the second detection temperature difference is calculated and stored for a plurality of continuously conveyed sheets, the differences of the plurality of sheets are processed according to a predetermined flow to obtain difference information, and a conveying state is determined based on the difference information. That is, difference data obtained during passing of a plurality of sheets is acquired and stored, a conveying state is determined based on difference information obtained by processing the difference data according to a predetermined method (for example, a statistical method), and the user is informed of the possibility that the sheet is not set properly.

Figure 13:
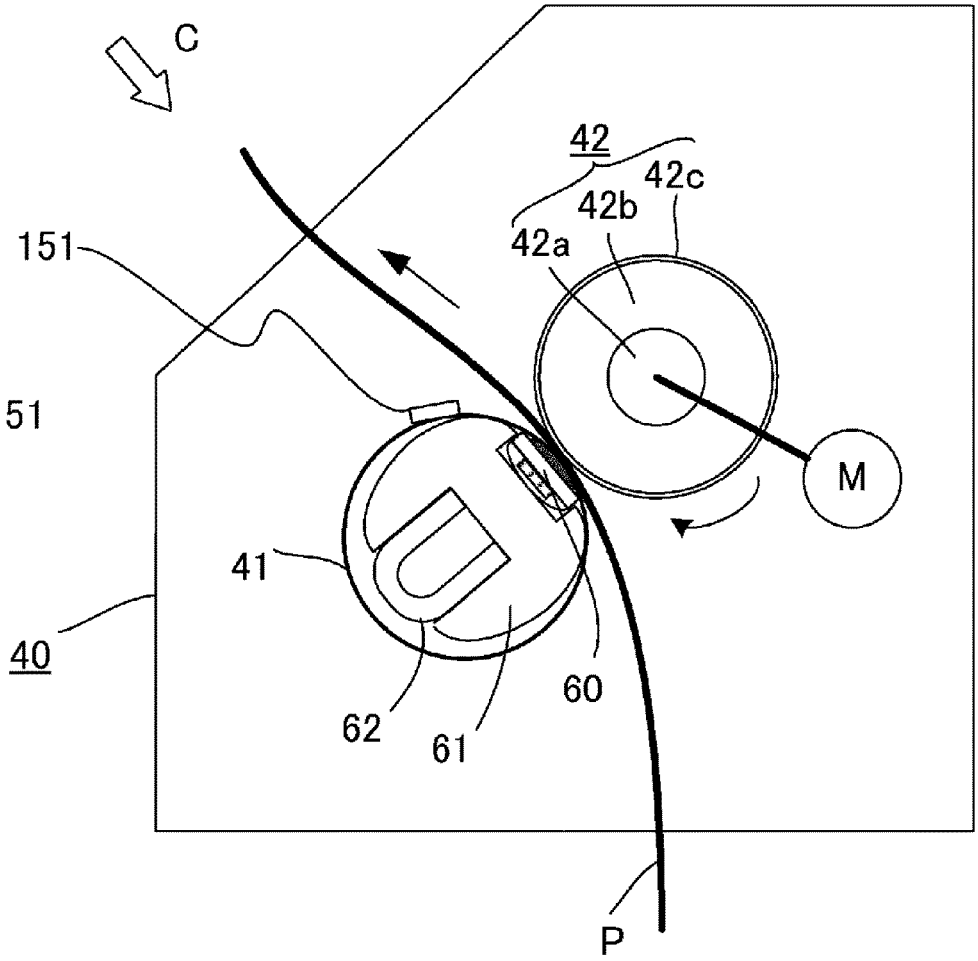
FIG. 13 is a cross-sectional view schematically illustrating a fixing apparatus according to Embodiment 2.

FIG. 13 is a schematic cross-sectional view of a fixing apparatus according to Embodiment 2.

End thermistors 151*a* and 151*b* which are a pair of end temperature detecting members are in contact with the surface of the fixing film 41 so that a temperature change in the fixing film 41 resulting from sheet-passing can be detected more directly. In the present embodiment, the end thermistors 151*a* and 151*b* are disposed near the ends of the largest sheet-passing width of the apparatus so as to be located 106 mm from the longitudinal center so that rubbing scratches on the fixing film 41 due to the rubbing between the end thermistors 151*a* and 151*b* and the fixing film 41 do not have an adverse effect on the image quality.

That is, substantially no adverse effect appears in the image quality since printing is controlled so that margins of 5 mm is secured on both ends of a normal printed material even when an LTR-size sheet is passed. Moreover, in an image formation process direction, as illustrated in FIG. 13, the end thermistors are disposed at a position separated by a predetermined angle in the downstream direction from the rear end of the fixing nip portion N. In the present embodiment, the angle is approximately 40°. At this position, the end thermistors can measure the temperature immediately after the downstream of the fixing nip portion N without becoming an obstacle to the conveying of sheets.

The other apparatus configuration is the same as Embodiment 1, and the same constituent elements will be denoted by the same reference numerals and the description thereof will not be provided.

In Embodiment 2, the change in the surface temperature of the fixing film 41 is measured in a direct or timely manner.

Although the data obtained during passing of each sheet is the difference (ΔTprint−ΔTbase) between the first detection temperature difference ΔTprint and the second detection temperature difference ΔTbase similarly to Embodiment 1, the set state of the sheet P can be determined more accurately by determining the conveying state from the trend of a plurality of sheets. According to this method, although a temporary phenomenon cannot be detected, since the number of unnecessary notifications to the user resulting from detection errors of skew or positional error conveying can be reduced, a well-balance apparatus can be provided to the user.

For example, when the set state of sheets P on the sheet feed cassette 21 or the sheet feed tray 26 is not appropriate, the conveying state may fluctuate from sheet to sheet. That is, skew may occur in one sheet-passing and may not occur in another sheet-passing. Thus, in Embodiment 2, when the difference |ΔTprint−ΔTbase| exceeds a reference value at a predetermined frequency or higher only, the user is informed of the possibility that the sheet set state is not appropriate.

That is, the control portion 100 as a determining unit temporarily detects that a conveying state is abnormal when the difference |ΔTprint−ΔTbase| of each of a plurality of recording materials (that is, for each of the conveyed sheets P) is equal to or larger than a temporary detection threshold which is a predetermined reference value and determines that the conveying state is abnormal (that is, skew or positional error conveying has occurred) when the number of temporary detections is equal to or larger than a predetermined number during the passing of the plurality of sheets.

Specifically, the temporary detection threshold V is set to 4° C. and it is determined whether the difference |ΔTprint−ΔTbase| is 4° C. or larger. When the difference |ΔTprint−ΔTbase| is 4° C. or larger, it is temporarily detected that a skewed or positional error conveyed state has occurred. When the skewed or positional error conveyed state is temporarily detected at a frequency of 3 times or more during passing of latest ten sheets or smaller, the detection of skew or positional error conveying is settled to determine that the conveying state is abnormal (that is, the skewed or positional error conveyed state has been detected), and a notification thereof is sent to the user.

In the present embodiment, the trend during passing of a plurality of sheets is detected, and the risk of a decrease in the usability resulting from detection errors is lower than that of Embodiment 1. Thus, the temporary detection threshold as a reference value is set to be smaller than the detection threshold of Embodiment 1.

In the present embodiment, the end thermistors are disposed differently from that of Embodiment 1 as described above. The end thermistors 151*a* and 151*b* make contact with the surface of the fixing film 41 immediately downstream the fixing nip portion N. In this configuration, since the period taken for the end thermistors 151*a* and 151*b* to detect the temperature change in the fixing film 41 is shortened as compared to Embodiment 1, the acquisition timings of ΔTbase and ΔTprint are set differently from those of Embodiment 1. The data acquisition timing of the first detection temperature difference ΔTbase in Embodiment 2 occurs in a period of 0.3 sec before the front end of the sheet P reaches the fixing nip portion N. Moreover, the data acquisition timing of the second detection temperature difference ΔTprint occurs in a period of 0.3 sec immediately after the rear end of the sheet P passes the fixing nip portion N.

The data acquisition timing of the first detect ion temperature difference ΔTbase is a period in which the surface temperature of the fixing film 41 is most t stable, occurring immediately before the front end of the sheet P reaches the fixing nip portion N. Moreover, the data acquisition timing of the second detection temperature difference ΔTprint is set to the timing at which the influence on the fixing film 41, of the sheet P passing through the fixing nip portion N can be detected without any influence of external disturbance.

Table 1 illustrates test results obtained when sheets were overloaded on the sheet feed tray 26 and ten sheets were continuously passed.

Skew or positional error conveying equal to larger than a determination criteria value occurs in second, eighth, and tenth sheets, and temporary skew or positional error conveying appears at a frequency of three times in 10 sheets. Thus, the skew or positional error conveying detection condition is satisfied, the detection of skew or positional error conveying is settled and the user is informed of the possibility that the sheet P is not set properly.

TABLE 1

| | First sheet | Second sheet | Third sheet | Fourth sheet | Fifth sheet | Sixth sheet | Seventh sheet | Eighth sheet | Ninth sheet | Tenth sheet |
|---|---|---|---|---|---|---|---|---|---|---|
| Δ Tbase | −1.5 | −1.0 | 0.4 | 2.3 | 3.4 | 5.0 | 4.6 | 5.7 | 5.4 | 6.4 |
| Δ Tprint | −1.2 | 3.1 | 2.8 | 5.0 | 4.3 | 4.9 | 6.0 | 10.1 | 8.8 | 10.8 |
| \|Δ Tprint − Δ Tbase\| | 0.3 | 4.1 | 2.4 | 2.7 | 0.9 | 0.1 | 1.4 | 4.4 | 3.4 | 4.4 |

Figure 14:
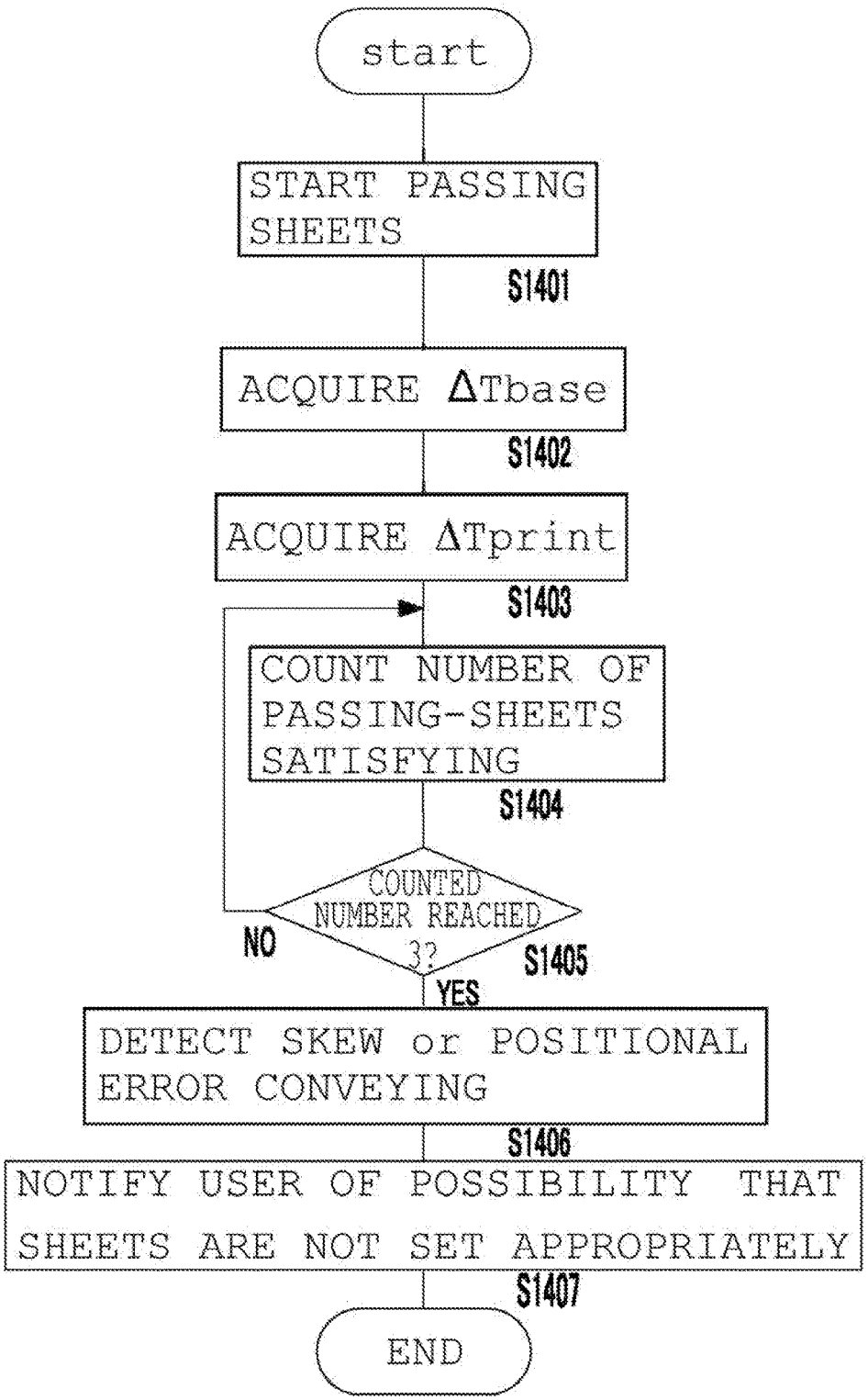
FIG. 14 is a flowchart for describing a conveying state determining process in Embodiment 2.

Next, the control flow of Embodiment 2 will be described according to the flowchart of FIG. 14, focusing on the difference from Embodiment 1.

When the image forming apparatus starts passing sheets (S1401), the control portion 100 acquires the first detection temperature difference ΔTbase and the second detection temperature difference ΔTprint in each sheet-passing (S1402 and S1403) similarly to Embodiment 1, and calculates a difference |ΔTprint−ΔTbase|. As the feature of Embodiment 2, the differences |ΔTprint−ΔTbase| obtained during the passing of the latest 10 sheets are stored in the RAM 103. Moreover, the number of passing-sheets which is the frequency corresponding to |ΔTprint−ΔTbase|≥4 among the items of difference data for ten passing-sheets is counted (S1404).

When the obtained number of passing-sheets (frequency) in which it is temporarily detected that skew or positional error conveying has occurred in the passing of latest ten sheets reaches the detection threshold (for example, three times) stored in the ROM 102 (S1405), abnormality detection is settled (S1406) and a notification is sent to the user (S1407).

According to this method, although the immediacy decreases as compared to Embodiment 1, more reliable information can be presented to the user without decreasing the detection sensitivity of each sheet-passing. That is, an apparatus in which a decrease in the usability resulting from detection errors rarely occurs can be provided to the user.

In the present embodiment, although the end thermistors 151*a* and 151*b* make contact with the fixing film 41, the arrangement is limited as described above when a contacting thermistor is used. Although the cost may increase if non-contacting thermopiles or the like are used as a temperature detector, the use of thermopiles provides merits in that there is no limitation on the arrangement position of the temperature detector in the longitudinal direction and the degree of freedom in settings of apparatuses is high.

A method of processing the items of difference data obtained during passing of a plurality of sheets is not limited to the above-described method. In the present embodiment, a notification is sent to the user when the difference exceeds the threshold three times or more during the passing of latest ten sheets or smaller. However, since it aims to increase the reliability more than the determination for each sheet, the notification may be sent when, for example, the difference exceeds the threshold two times during the passing of the latest five sheets or smaller.

In another example, the value of the difference |ΔTprint−ΔTbase| may be measured and stored for a number of passing-sheets, the standard deviation of the difference |ΔTprint−ΔTbase| may be calculated, and a notification indicating that the set state of the sheets P is not appropriate may be sent based on the degree of fluctuation. As another determination condition, instead of using the frequency in a predetermined number of sheets, a condition that the |ΔTprint−ΔTbase| continuously exceeds a predetermined reference value may be used.

Moreover, a determination condition that the sum of the differences |ΔTprint−ΔTbase| measured and stored for a plurality of passing-sheets exceeds a predetermined reference value may be used.

In the present embodiment, similarly to Embodiment 1, although the arrangement positions of the end thermistors 151*a* and 151*b* at both longitudinal ends are located slightly closer to the center of the ends of a sheet-passing width of a target sheet of which the skew or positional error conveying is to be detected, the arrangement positions may be located closer to the outer side (close to the ends of the film) than the ends of the sheet-passing width. Since a difference in the amount of heat supplied from the fixing film 41 to the sheet at the arrangement positions of the end thermistors 151*a* and 151*b* or a temperature difference in the longitudinal direction due to a temperature increase in the non-sheet-passing portion occurs due to the skew or positional error conveying, the skew or positional error conveying can be detected according to the above-described method.

Embodiment 3

Similarly to Embodiment 2, Embodiment 3 is an example of a method of calculating and storing the difference between the first detection temperature difference and the second detection temperature difference during the continuous conveying of a plurality of sheets and determining a conveying state from the differences of the plurality of sheets. The apparatus configuration is the same as that of Embodiment 2.

In Embodiment 3, a fluctuation in the conveying state of a sheet, which is a feature when the sheets are not set appropriately on the sheet feed cassette or the tray is focused on, and the skew is detected using an average and a variance of the difference |ΔTprint−ΔTbase| which is the change in the temperature difference at both longitudinal ends.

A variance and a standard deviation which are statistical amounts are generally used as an index of a fluctuation of data. In the present embodiment, the variance is calculated because the central processing unit (CPU) 101 in the control portion 100 performs four arithmetic operations. A skew detection index is not limited to a standard deviation or a variance as long as the index calculates the degree of fluctuation.

When data follows a normal distribution, it is known that 99.7% of data (that is, substantially all values) falls within a range of (Average (N))±(Standard deviation (σ))×3. In the present embodiment, there is a fluctuation in the skew due to the fact that the sheets P are not set appropriately as described above, and the amount of skew exhibits a normal distribution. Thus, the difference |ΔTprint−ΔTbase| which is the amount of change in the detection temperature difference of the end thermistors 151*a* and 151*b* at both longitudinal ends, resulting from skew also has a fluctuation and exhibits a normal distribution.

In Embodiment 1, a method in which the detection threshold V as a reference value is set to 5° C. and it is determined that the sheet is skewed or conveyed with positional when the temperature difference at both longitudinal ends changes 5° C. or more due to sheet-passing has been illustrated. On the other hand, even when the temperature difference during passing of one sheet does not exceeds a threshold and the skew or positional error conveying is not detected in Embodiment 1, the change in the temperature difference at both longitudinal ends may fluctuate when the sheets are not set appropriately as described above. In such a case, as illustrated in Embodiment 3, by introducing the standard deviation a, it is possible to detect skew or positional error conveying and to predict the set state of sheets.

Specifically, the range of difference |ΔTprint−ΔTbase| which is the data following the normal distribution is represented using an average and a standard deviation of the difference data |ΔTprint−ΔTbase| as Expression 3 below. When the largest value of the data range defined by the average and the standard deviation exceeds a detection threshold V which is a predetermined reference value, it can be determined that the set state of sheets is not desirable and a notification can be sent to the user. Here, the threshold of the change in the temperature difference at both longitudinal ends, for detecting skew of the sheet P is 5° C. similarly to Embodiment 1.

That is, the determination expression is expressed by the following expression.

$$(\text{Average of } |\Delta T\text{print}-\Delta T\text{base}|)+(3\times(\text{Standard deviation } (\sigma)) \text{ of } |\Delta T\text{print}-\Delta T\text{base}|)\geq 5 \quad \text{(Expression 3)}$$

However, as described above, since a variance $\sigma^2$ is used instead of the standard deviation a in Embodiment 3, Expression 3 is modified as follows.

$$\text{Variance } (\sigma^2) \text{ of } |\Delta T\text{print}-\Delta T\text{base}|\geq\{(5-|\Delta T\text{print}-\Delta T\text{base}|\text{average})/3\}\hat{}2 \quad \text{(Expression 4)}$$

Skew is detected when this expression is satisfied.

Table 2 illustrates measurement values of difference data |ΔTprint−ΔTbase| when ten sheets are continuously printed, for Case (A) where skew is not included and Case (B) where skew is included. Here, the data for the case where skew is included in the same as that used in Embodiment 2.

TABLE 2

| | First sheet | Second sheet | Third sheet | Fourth sheet | Fifth sheet | Sixth sheet | Seventh sheet | Eighth sheet | Ninth sheet | Tenth sheet |
|---|---|---|---|---|---|---|---|---|---|---|
| (A) Normal continuous sheet-passing (skew not included) \|ΔTprint − ΔTbase\|average: 0.34 Variance: 0.54 | | | | | | | | | | |
| Δ Tbase | −1.8 | −1.2 | −0.9 | −0.4 | −0.3 | −0.0 | 0.4 | 0.3 | 0.5 | 0.5 |
| Δ Tprint | −1.1 | 0.2 | 0.4 | −1.3 | 0.4 | 0.1 | 0.0 | 0.2 | 1.4 | 0.3 |
| \|Δ Tprint − Δ Tbase\| | 0.7 | 1.4 | 1.3 | 0.9 | 0.7 | 0.1 | 0.4 | 0.1 | 0.9 | 0.3 |
| (B) Continuous sheet-passing (skew included) \|ΔTprint − ΔTbase\|average: 2.41 Variance: 2.49 | | | | | | | | | | |
| Δ Tbase | −1.5 | −1.0 | 0.4 | 2.3 | 3.4 | 5.0 | 4.6 | 5.7 | 5.4 | 6.4 |
| Δ Tprint | −1.2 | 3.1 | 2.8 | 5.0 | 4.3 | 5.1 | 6.0 | 10.1 | 8.8 | 10.8 |
| Δ Tprint − Δ Tbase | 0.3 | 4.1 | 2.4 | 2.7 | 0.9 | 0.1 | 1.4 | 4.4 | 3.4 | 4.4 |

When there is no problem in the sheet setting, the average of the difference data |ΔTprint−ΔTbase| is 0.34 and the variance is 0.54. Since the right side of Expression 4 is 2.41, the skew or positional error conveying detection condition is not satisfied.

On the other hand, when there is a problem in the sheet setting and skew or positional error conveying is included during continuous sheet-passing, the average of |ΔTprint−ΔTbase| is 2.41 and the variance is 2.49. The right side of Expression 4 is 0.75. As a result, the conditional expression is satisfied, and skew or positional error conveying is detected and a notification is sent to the user.

In Embodiment 3, although the average and the variance of the difference data |ΔTprint−ΔTbase| are used, skew may be detected based on the magnitude of the variance only. Moreover, in the present embodiment, although an example in which the fluctuation is ±3σ has been described, the present invention is not limited to this and the fluctuation range may be set according to the purpose.

Embodiment 4

Embodiment 4 illustrates a method of analyzing information obtained during passing of a plurality of sheets similarly to Embodiment 2, accurately detecting skew or positional error conveying with a relatively smaller number of passing-sheets even when skew or positional error conveying cannot be determined with one passing-sheet, and sending a notification to the user.

Conventionally, when a sheet P conveyed with positional error according to the determination criteria is passed, sheet-passing is continued without decreasing the throughput until a relatively large temperature difference occurs by putting a greater importance on the usability (maintained throughput). However, when sheet-passing is continued with a temperature difference occurring in the longitudinal direction, the fixing film 41 may be exposed to a higher temperature than expected. Moreover, biasing force may be generated in the fixing film 41 due to a lateral temperature difference, and the ends of the fixing film 41 may receive stress repeatedly. Thus, the lifespan of the fixing film may decrease. Thus, it may be desirable for users to be informed of the fact that the set state of sheets P is not desirable at a relative early stage.

In positional error conveying which occurs when the ends are not sufficiently held by the regulating plate, the temperature difference in the longitudinal direction of the fixing apparatus spreads slightly when the amount of sheet shifting from a reference conveying position is small. Thus, it may not be possible to detect the set state of the sheet P in each sheet-passing.

In Embodiment 4, a method of determining skew or positional error conveying from the trend of the change in the difference (ΔTprint−ΔTbase) will be described.

Unlike Embodiments 1 to 3, when the difference (ΔTprint−ΔTbase) between the first detection temperature difference and the second detection temperature difference tends to increase or decrease during passing of a plurality of continuous sheets, it is determined that there is an abnormality in the conveying state of recording materials.

That is, in the positional error conveying, it is expected that a sheet is set on the sheet feed cassette 21 or the sheet feed tray 26 in a state of being shifted to one side in the sheet width direction. When a state in which the sign of the difference (ΔTprint−ΔTbase) does not change (that is, the temperature difference in the longitudinal direction increases or decrease monotonously) is detected, it is determined that the sheet is passed with positional error.

In Embodiment 4, the positional error conveying is determined based on a moving average of differences for a plurality of continuously held sheets. Specifically, (ΔTprint−ΔTbase) is averaged whenever three sheets P are passed, and when the sign of the average does not change for five times (that is, the sign is positive or negative for all five times), it is determined that the positional error conveying has occurred.

When a sheet P is conveyed with positional error in the sheet width direction, a temperature increase in the non-sheet-passing portion rarely occurs on the side where the sheet approaches, whereas a temperature increase in the non-sheet-passing portion on the opposite end increases. As a result, the temperature difference in the longitudinal direction of the fixing apparatus gradually increases. That is, when the positional error conveying occurs continuously, the difference data (ΔTprint−ΔTbase) in each sheet-passing has the positive or negative value substantially continuously. However, the polarity may be reversed due to factors such as fluctuation of the detected temperature. Thus, in Embodiment 4, in order to detect the spreading trend of the temperature difference more accurately, the positional error conveying is determined based on a moving average of data as a statistical amount.

Table 3 illustrates the results when sheets are continuously passed in a state where a sheet is shifted 2 to 3 mm from the reference position of the sheet.

TABLE 3

(A) Measurement value in respective sheet-passing

| | First sheet | Second sheet | Third sheet | Fourth sheet | Fifth sheet | Sixth sheet | Seventh sheet |
|---|---|---|---|---|---|---|---|
| Δ Tbase | 2.0 | 2.1 | 3.5 | 3.6 | 4.4 | 4.8 | 5.3 |
| Δ Tprint | 3.5 | 3.5 | 4.4 | 4.5 | 4.9 | 4.8 | 5.6 |
| Δ Tprint − Δ Tbase | 1.5 | 1.4 | 0.9 | 0.9 | 0.5 | 0.0 | 0.3 |

(B) Moving average calculated from data in (A)

| | First to third sheets | Second to fourth sheets | Third to fifth sheets | Fourth to sixth sheets | Fifth to seventh sheets |
|---|---|---|---|---|---|
| ΔTprint − ΔTbase (moving average) | 1.3 | 1.1 | 0.8 | 0.5 | 0.3 |

In the test by the inventor illustrated in Table 3A, although the difference data (ΔTprint−ΔTbase) generally exhibited a tendency to have a positive value, the difference data sometimes was 0 as in the sixth sheet and had a negative value in other cases. However, as illustrated in Table 3B of the present embodiment, by measuring the moving average, the measurement accuracy can be improved by suppressing fluctuation in the detected temperature. The number of averages and the arithmetic operation on the acquired data are not limited to those of the present embodiment. For example, a larger number of averages make it easy to detect the tendency. However, an increase number of averages may extend the time required for positional error conveying detection. Thus, in the present embodiment, the averages of ΔTprint−ΔTbase obtained from three passing-sheets were used.

According to the method of the present embodiment, it is possible to determine that the set state of sheets P is not desirable also when, for example, relatively small skew occurs continuously as well as positional error conveying. Moreover, when a threshold of the absolute value of the temperature difference in the longitudinal direction of the fixing apparatus may be provided as in the conventional technique in addition to the above-described arithmetic operation, the positional error conveying can be detected at a timing equivalent to the conventional technique although the positional error conveying cannot be detected at an early stage. In this way, a positional error conveying detection function which is at least better than the conventional technique may be provided by having two determination criteria.

The image forming apparatus is not limited to such a multi-functional peripheral as the image forming apparatus illustrated in FIG. 1 but the present invention can be broadly applied to an image forming apparatus having a heating and fixing portion, such as a facsimile, a printer, or a copying machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-015063, filed Jan. 29, 2015, which is hereby incorporated by reference herein in its entirety.

What is claimed is:

1. A fixing apparatus that heats a recording material on which an image is formed while conveying the recording material through a nip portion to fix the image on the recording material, the fixing apparatus comprising:

a heating unit;

a backup member that forms the nip portion together with the heating unit;

a temperature detecting portion that detects a temperature of the heating unit, the temperature detecting portion including a first temperature detecting member that detects a temperature at one end of the heating unit in a longitudinal direction of the heating unit and a second temperature detecting member that detects a temperature at the other end of the heating unit in the longitudinal direction of the heating unit;

an acquiring portion that acquires a difference value between a detection temperature of the first temperature detecting member and a detection temperature of the second temperature detecting member; and an alarming portion that sends a notification to a user in a case where a difference, between the two difference values acquired at different timings while conveying one recording material through the nip portion, exceeds a threshold, the notification indicating a possibility of a positional error of the recording material.

2. The fixing apparatus according to claim 1, wherein the threshold is different depending on a basis weight of the recording material.

3. The fixing apparatus according to claim 1, wherein the threshold is different depending on a size of the recording material.

4. The fixing apparatus according to claim 1, wherein:

the heating unit includes a cylindrical film and a nip forming member contacting an inner surface of the cylindrical film, the nip forming member forming the nip portion with the backup member through the cylindrical film, and the first temperature detecting member and the second temperature detecting member detect a temperature of the nip forming member.

5. The fixing apparatus according to claim 4, wherein the nip forming member is a heater.

6. The fixing apparatus according to claim 1, wherein the different timings are a timing just after a front end of one recording material reaches the nip portion and a timing just before a rear end of the one recording material passes the nip portion.

7. A fixing apparatus that heats a recording material on which an image is formed while conveying the recording material through a nip portion to fix the image on the recording material, the fixing apparatus comprising:

a heating unit;

a backup member that forms the nip portion together with the heating unit;

a temperature detecting portion that detects a temperature of the heating unit, the temperature detecting portion including a first temperature detecting member that detects a temperature at one end of the heating unit in a longitudinal direction of the heating unit and a second temperature detecting member that detects a temperature at the other end of the heating unit in the longitudinal direction of the heating unit;

an acquiring portion that acquires a difference value between a detection temperature of the first temperature detecting member and a detection temperature of the second temperature detecting member; and an alarming portion that sends a notification to a user in a case where a difference, between two difference values acquired at different timings, exceeds a threshold, the different timings being a timing just before or just after a front end of one recording material reaches the nip portion and a timing just before or just after the rear end of the one recording material passes the nip portion, the notification indicating a possibility of a positional error of the recording material.

8. The fixing apparatus according to claim 7, wherein:

the heating unit includes a cylindrical film and a nip forming member contacting an inner surface of the cylindrical film, the nip forming member forming the nip portion with the backup member through the cylindrical film, and the first temperature detecting member and the second temperature detecting member detect a temperature of the nip forming member.

9. The fixing apparatus according to claim 8, wherein the nip forming member is a heater.

10. The fixing apparatus according to claim 7, wherein the threshold is different depending on a basis weight of the recording material.

11. The fixing apparatus according to claim 7, wherein the threshold is different depending on a size of the recording material.

12. A fixing apparatus that heats a recording material on which an image is formed while conveying the recording material through a nip portion to fix the image to the recording material, the fixing apparatus comprising:

a heating unit;

a backup member that forms the nip portion together with the heating unit;

a temperature detecting portion that detects a temperature of the heating unit, the temperature detecting portion including a first temperature detecting member that detects a temperature at one end of the heating unit in a longitudinal direction of the heating unit and a second temperature detecting member that detects a temperature at the other end of the heating unit in the longitudinal direction of the heating unit;

an acquiring portion that acquires a difference value between a detection temperature of the first temperature detecting member and a detection temperature of the second temperature detecting member; and an alarming portion that sends a notification to a user in a case where the number of times, that a difference between the two difference values acquired at different timings exceeds a threshold, reaches a predetermined number of times during continuously conveying of a plurality of recording materials through the nip portion, the different timings being a timing just before or just after a front end of one recording material reaches the nip portion and a timing just before or just after the rear end of the one recording material passes the nip portion, the notification indicating a possibility of a positional error of the recording material.

13. The fixing apparatus according to claim 12, wherein:

the heating unit includes a cylindrical film and a nip forming member contacting an inner surface of the cylindrical film, the nip forming member forming the nip portion with the backup member through the cylindrical film, and the first temperature detecting member and the second temperature detecting member detect a temperature of the nip forming member.

14. The fixing apparatus according to claim 13, wherein the nip forming member is a heater.

* * * * *